United States Patent [19]

Itaya

[11] Patent Number: 4,462,679

[45] Date of Patent: Jul. 31, 1984

[54] ELECTRONIC COPYING MACHINE

[75] Inventor: Keiji Itaya, Yokohama, Japan

[73] Assignee: Tokyo Shibaura Denki Kabushiki Kaisha, Kawasaki, Japan

[21] Appl. No.: 342,226

[22] Filed: Jan. 25, 1982

[30] Foreign Application Priority Data

Feb. 2, 1981 [JP] Japan ..... 56-13922

[51] Int. Cl.[3] ..... G03G 15/02

[52] U.S. Cl. ..... 355/14 CH; 355/3 CH; 355/14 E

[58] Field of Search ..... 355/3 TR, 3 CH, 14 R, 355/14 TR, 14 CH, 14 E

[56] References Cited

U.S. PATENT DOCUMENTS 4,239,374 12/1980 Tatsumi et al. ..... 355/14 E 4,348,099 9/1982 Fantozzi ..... 355/14 CH X

FOREIGN PATENT DOCUMENTS 3041745 5/1981 Fed. Rep. of Germany .

*Primary Examiner*—Fred L. Braun

*Attorney, Agent, or Firm*—Cushman, Darby & Cushman

[57] ABSTRACT

An electronic copying machine having a control circuit with a microprocessor including a read-only memory which stores a predetermined timing constant to control a charging timing of a charger and an exposure timing of an exposure unit in such a manner that a leading end of a toner-image forming area of a photosensitive drum which corresponds to a leading end of a copying paper sheet is charged by the charger and exposed by the exposure unit only after the leading end is exposed to a transfer charger, separating charger, discharger and discharge lamp.

6 Claims, 37 Drawing Figures

| SR \ CYCLE | 0 | 1 | 2 | 3 | 4 |
|---|---|---|---|---|---|
| SR0 | 0 | 1 | 0 | 0 | 0 |
| SR1 | 0 | 0 | 1 | 0 | 0 |
| SR2 | 0 | 0 | 0 | 1 | 0 |
| SR3 | 0 | 0 | 0 | 0 | 1 |

| SR \ CYCLE | 0 | 1 | 2 | 3 | 4 | 5 |
|---|---|---|---|---|---|---|
| SR0 | 0 | 1 | 1 | 0 | 0 | 0 |
| SR1 | 0 | 0 | 1 | 1 | 0 | 0 |
| SR2 | 0 | 0 | 0 | 1 | 1 | 0 |
| SR3 | 0 | 0 | 0 | 0 | 1 | 1 |

241
245
247
249
243
251
253
255
EXIT-ROLLER JAM-1
HEAT-ROLLER
JAM-2
TRANSFER
ALIGN-ROLLER
DEVELOPER
FEED-ROLLER
EXPOSURE
CHARGING
ERASE-LAMP
BLADE-CLEANING
DISCHARGING
(TRANSFER)

TRAILING EDGE OF ORIGINAL (B4)
TRAILING EDGE OF ORIGINAL (B5)
LEADING EDGE OF ORIGINAL
0 TH CYCLE
1 ST CYCLE
2 ND CYCLE
3 RD CYCLE
4 TH CYCLE

ELECTRONIC COPYING MACHINE

BACKGROUND OF THE INVENTION

The present invention relates to an electronic copying machine in which a transfer charger, a discharge charger, a discharge lamp and so on are disposed around a cylindrical photosensitive drum.

In general, the various devices for forming an electrostatic latent image are arranged in an electronic copying machine. In particular, a charger, an exposure system, a developing unit, a transfer charger, a separation charger, a discharger, a cleaner, and a discharge lamp are arranged in the direction of rotation of the cylindrical photosensitive drum. In this case, when a copying switch is depressed, the photosensitive drum starts rotating. Simultaneously, the transfer charger, the separation charger and the discharger start operating, and the discharge lamp is lit. DC corona chargers are generally used as the charger and the transfer charger. With the transfer charger, a transfer corona which has a polarity opposite to the polarity of a toner image which is formed on the surface of the photosensitive drum is radiated on the back surface of a copying paper sheet, so that the toner image is transferred to the copying paper sheet. With the separation charger, an AC corona charger is used. A separation corona is radiated to separate the copying paper sheet from the photosensitive drum is such a way that the electric charge on the paper sheet is neutralized. That is, the amount of discharge is large when the AC corona charger has a polarity opposite to that of the transfer charger while the amount of the AC corona charger is small when the AC corona charger has same polarity to that of the transfer charger. The discharge lamp exposes the entire surface of the photosensitive drum which is, in turn, temporarily rendered conductive, so that the electric charge on the surface of the photosensitive drum is neutralized and eliminated. Therefore, in the process for forming an electrostatic latent image beginning from the transfer charger position as shown in FIG. 1, (i) the photosensitive drum is charged by the transfer charger to a predetermined potential; (ii) the surface potential on the photosensitive drum is lowered by a predetermined level when the electric charge which has a polarity opposite to the polarity of the transfer charge is applied by the separation charger and the discharge charger; and (iii) when discharge lamp is exposed the surface potential on the photosensitive drum is lowered to the voltage of around 0 V. The discharger electrically discharges the toner which remains on the surface of the photosensitive drum and generally comprises an AC corona charger. The discharge effectiveness of the AC corona charger in the negative phase is higher than that in the positive phase so that the surface potential of the photosensitive drum is lowered.

When the photosensitive drum is entirely exposed by the discharge lamp, electric charge is grounded which has a polarity opposite to the polarity of a toner image which is formed on the surface of the photosensitive drum. Therefore, when the electric charge is grounded which has a polarity opposite to the polarity of the toner image which is formed on the surface of the photosensitive drum, the surface potential on the surface of the photosensitive drum can be lowered by discharge by the discharge lamp. However, when the electric charge has the same polarity as the polarity of the toner image which is formed on the surface of the photosensitive drum, the surface potential on the photosensitive drum cannot be lowered by discharge by the discharge lamp. Assume that a copying switch is depressed when a prospective area on the photosensitive drum in which a toner image is to be formed in the first copying operation is located between the transfer charger and the discharge charger. The prospective area is first exposed to the separation charger, the discharger and the discharge lamp before reaching the charger at the beginning of the imaging process. This prospective area is not exposed to the transfer charger. As a result, the discharge charger charges the prospective area with electric charge whose polarity is the same as that of the toner image which is to be formed on the surface of the photosensitive drum so that the photosensitive drum can not be discharged by the discharge lamp. Nevertheless, the process for forming the electrostatic latent image on the photosensitive drum is performed after exposure to the discharge lamp. This process is indicated by a broken line as shown in FIG. 1.

When an image is to be applied to an area of the photosensitive drum which lies before the transfer charger with respect to the rotational direction of the photosensitive drum while the drum is at rest, this area is exposed to the transfer charger, the separation charger, the discharger and the discharge lamp before reaching the charger. Thus, this area is charged by the transfer charger with electric charge whose polarity is opposite to that of the toner image which is to be formed on the surface of the photosensitive drum. Then, electric charge whose polarity is opposite to that of the transfer charger and which is less than the electric charge of the transfer charger is stored on the surface of the photosensitive drum by the separation charger and the discharge charger, so that the potential on the surface of the photosensitive drum is lowered by a predetermined level. However, the polarity of the surface potential on the photosensitive drum remains opposite to the polarity of the toner image which is formed on the surface of the photosensitive drum. Therefore the process by the discharge lamp is performed effectively, reducing the charge on the drum to around OV. Then the process for forming an electrostatic latent image on the photosensitive drum is performed, as indicated by a solid line in FIG. 1. Therefore, a potential difference is established between the area of the photosensitive drum which is located between the transfer charger and the separation charger, and the area on the photosensitive drum which is before the transfer charger in the rotational direction of the drum. In other words, an irregular potential distribution occurs on the area which is used for the first copying operation. As a result, a concentration difference occurs within the image of the first copying paper sheet, and between the image of the first copying paper sheet and the subsequent copying paper sheets.

SUMMARY OF THE INVENTION

It is an object of the present invention to eliminate the problems as described above and to provide an electronic copying machine which produces a copying image of uniform concentration thus eliminating a concentration difference within a single image or between images transferred to a continuous copying roll of paper.

In order to achieve the above and other objects of the present invention, there is provided an electronic copying machine having photosensitive means for selectively retaining an electrostatic latent image;

charger means for charging the surface of said photosensitive means;

exposure means for exposing said photosensitive means with an image from a document to form said electrostatic latent image thereof;

developing means for applying a toner to the electrostatic latent image to form a toner image;

transfer charger means for transferring the toner image to a transfer medium; and discharge lamp means for exposing the surface of said photosensitive means to render it conductive so that charges on the surface of the photosensitive means are neutralized.

An important aspect of this invention is that it includes control means for controlling a charging timing of said charger means and an exposure timing of said exposure means in such a manner that even when making a first copy, a leading end of a toner-image forming area of said photosensitive means which corresponds to a leading end of the transfer medium, is first exposed to said corona charger means and said discharge lamp means before being charged by said charger means and the present invention exposed by said exposure means.

According to the present invention, since the leading end of the toner-image forming area of the photosensitive drum is defined as the area which has been exposed to the transfer charger, the separation charger and the discharge lamp, the potential on the surface of the photosensitive drum is kept constant independent of the drum position at the beginning of a copying process. Therefore, the concentration difference on the surface of the same copying paper sheet and on the continuous copying roll of paper is eliminated, accomplishing an excellent copying image.

A corona charger means may also be provided between that transfer charger means and the discharge lamp means which has a polarity opposite to that of the toner image. The control means would then control timing so that the image forming process does not begin until the leading edge of the image forming area is exposed to said corona charger means and said discharge lamp means.

BRIEF DESCRIPTION OF THE DRAWINGS

Other objects and features on the invention will become apparent to those skilled in the art as the disclosure is made in the following description of a preferred embodiment of the present invention, as illustrated in the accompanying drawings, in which:

FIGS. 3A and 3B show a timing disc which obtains timing signals required for the copying operation of the electronic copying machine according to the present invention in which FIG. 3A is a plan view thereof and FIG. 3B is a side view thereof;

FIGS. 6A to 6G show the relations between the timing signals obtained from the timing disc and corresponding processing cycles in the electronic copying machine of FIG. 2 in which FIG. 6A shows a reset pulse, FIG. 6B shows a timing pulse, and FIGS. 6C to 6G show cycles at every one-half rotation of the timing disc;

FIGS. 7A and 7B are timing charts showing the relation between each process and its timing in the electronic copying machine according to the present invention in which FIG. 7A is a timing chart for explaining each process such as transfer, discharging, blade-cleaning, erase-lamp, charging, exposure, feed-roller, developer, align-roller, transfer, heat roller, and exit roller, and FIG. 7B shows the timing of the reciprocal movement of a document table;

FIGS. 11A to 11I are timing charts of the timing signals which are used for the electronic copying machine according to the present invention in which FIG. 11A shows a timing signal of a reset pulse (RP), FIG. 11B shows a timing pulse (TP), FIG. 11C shows timing signals for a motor relay, FIG. 11D shows timing signals for an exposure lamp, FIG. 11E shows timing signals for a developing roller clutch and a heat roller solenoid, FIG. 11F shows timing signals for a charger, FIG. 11G shows timing signals for a transfer charger, FIG. 11H shows a timing signal for a paper feed clutch, and FIG. 11I shows timing signals for a paper start clutch.

DETAILED DESCRIPTION OF THE PREFERRED EMBODIMENTS

Figure 1:
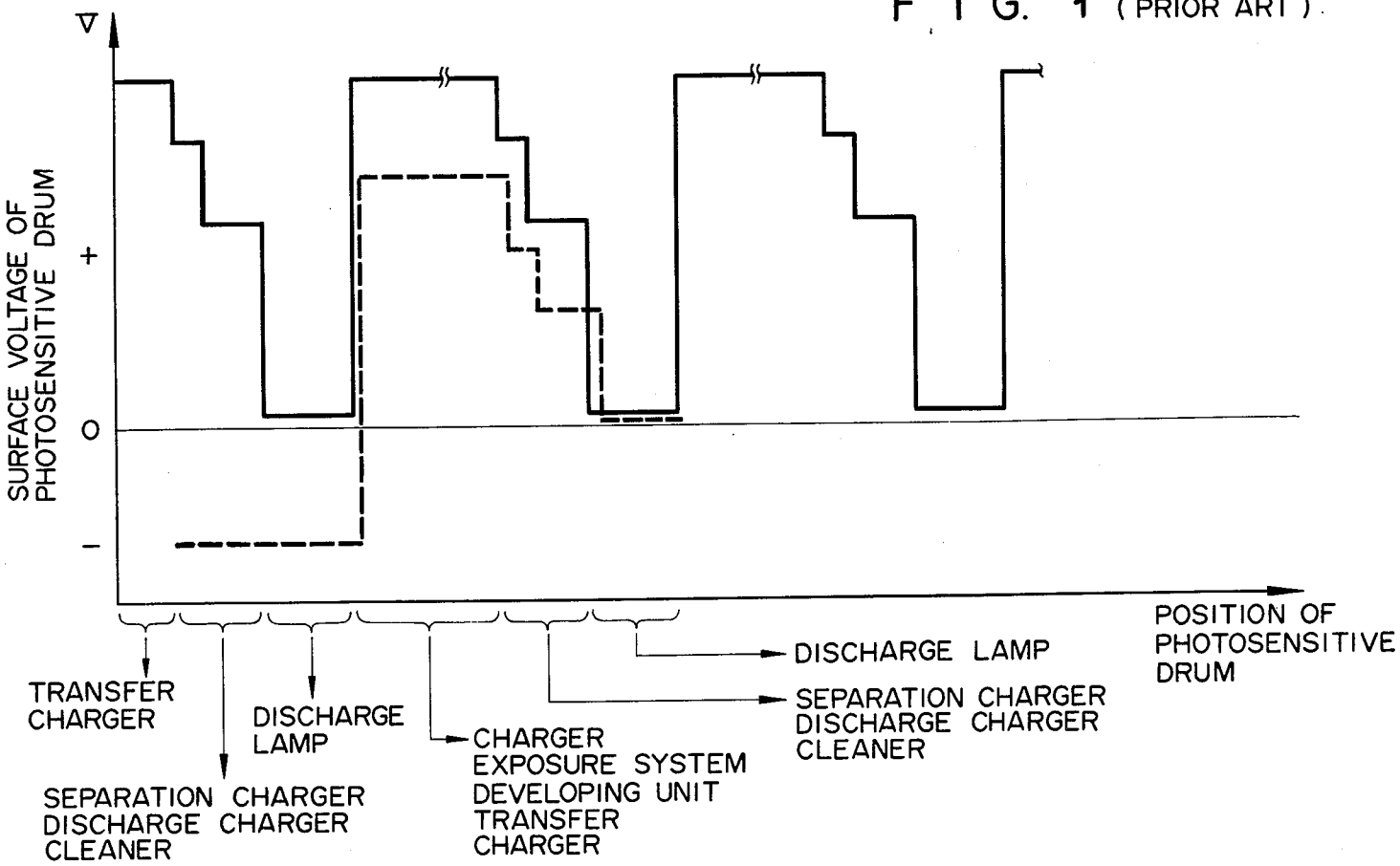
FIG. 1 (PRIOR ART)
FIG. 1 is a view for explaining the relation between the position of a photosensitive drum and a surface potential in order to clarify drawbacks of the conventional copying machines.
Figure 2:
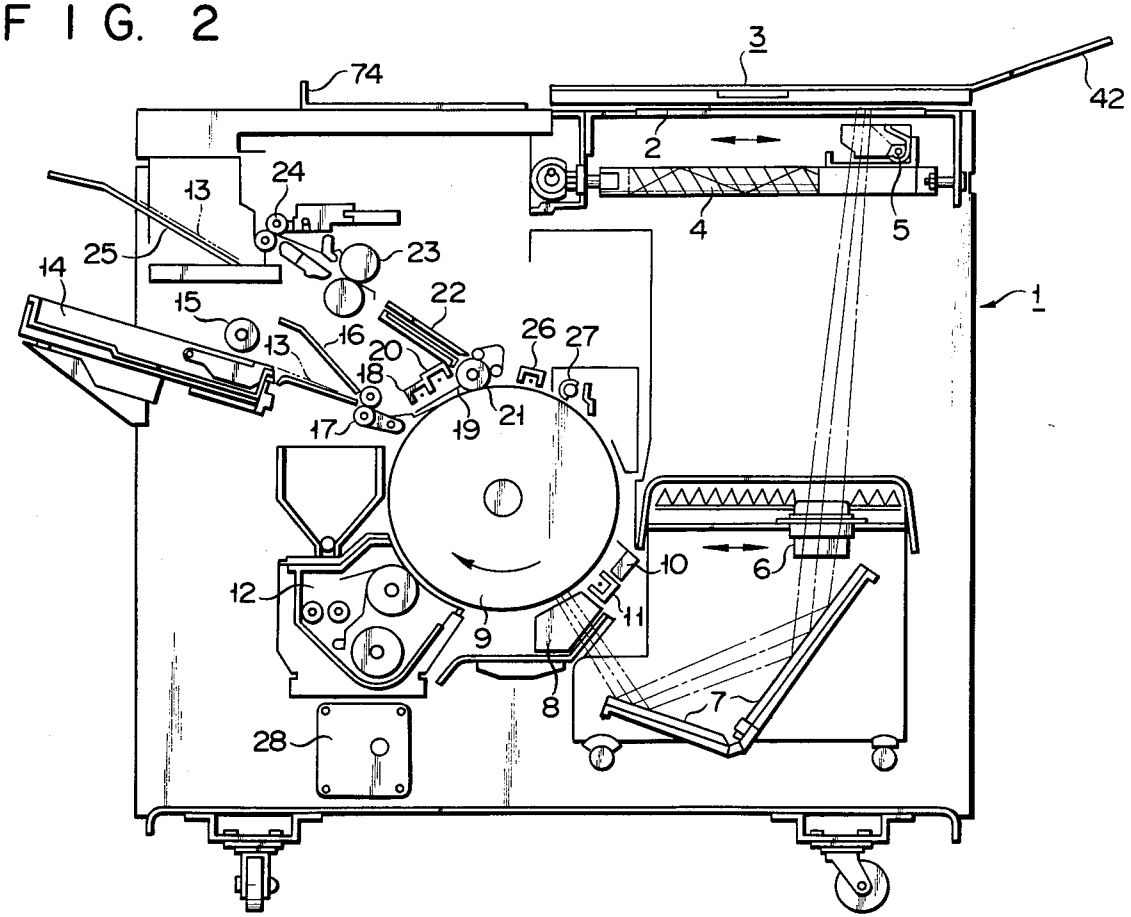
FIG. 2 is a side view schematically showing the overall arrangement of an electronic copying machine according to the present invention.

FIG. 2 shows the basic arrangement of an electronic copying machine to which the present invention is applied. A document table (transparent glass table) 2 is disposed on the upper right side of a copying machine main body 1. An automatic document feeder 3 is disposed so as to cover the upper surface of the document table 2. The automatic document feeder 3 is free to open and close easily. A document which is placed on the document table 2 is radiated by light from an exposure lamp 5 which reciprocally moves in the direction indicated by arrows. The light reflected from the document passes through a lens 6 which moves reciprocally in the direction indicated by arrows, is reflected by mirrors 7, and reaches a photosensitive drum 9 through an exposure slit body 8. As a result, an image of the document is formed on the surface of the photosensitive drum 9 by slit exposure. Along the rotational direction of the photosensitive drum 9 from the image formed thereon, a developing unit 12, a transfer charger 18, a separation charger 20, a discharger 26, a cleaner 27, a discharge lamp 10 and a charger 11 are disposed in the order named. The charger 11 applies a DC corona charge to the surface of the photosensitive drum 9, so that the surface of the photosensitive drum 9 is charged. The developing unit 12 visualizes an electrostatic latent image of the document which is formed on the photosensitive drum 9 to provide a toner image. The transfer charger 18 applies a DC corona charge whose polarity is the same as the electric charge of the charger 11, on a copying paper sheet 13 which is present between the transfer charger 18 and the photosensitive drum 9. In particular, a transfer corona whose polarity is opposite to that of a toner image which is formed on the photosensitive drum 9 is radiated from the back of the copying paper sheet by the transfer charger 18 so that the toner image is transferred to the copying paper sheet 13. The separation charger 20 applies an AC corona charge, to the copying sheet paper 13 which was charged by the transfer charger 18 and which is tightly attached on the photosensitive drum 9 so that the charge caused by the transfer charger is neutralized. An AC separation corona which neutralize the charge caused by the transfer charger 18 is radiated from the back surface of the copying paper sheet 13 by the separation charger 20. Therefore, the copying paper sheet 13 is separated from the photosensitive drum 9. The discharger 26 comprising an AC corona charger, discharges the toner, which is not transferred and remains on the surface of the photosensitive drum 9. The cleaner 27 removes from the surface of the photosensitive drum 9 the toner which is not transfered and was discharged by the discharger 26. The discharge lamp 10 exposes the entire surface of the photosensitive drum 9 so that the photosensitive drum 9 is temporarily rendered conductive and the electric charge on the surface of the photosensitive drum 9 is neutralized and eliminated. The photosensitive drum 9 is grounded and only the electric charge whose polarity is opposite to that of the toner image which is formed on the surface of the photosensitive drum is grounded when the discharge lamp 10 exposes the entire surface of the photosensitive drum 9. The electric charge whose polarity is opposite to that of the toner image formed on the surface of the photosensitive drum 9 is discharged by the discharge lamp 10.

On the other hand, the copying paper sheet is fed from a paper supply cassette 14 by a paper feed roller 15 to a transfer section by aligning rollers 17 through a guide path 16. The copying paper sheet 13 which is fed to the transfer section tightly attaches to the photosensitive drum 9 by the action of the transfer charger 18, so that the toner image on the photosensitive drum 9 is transferred to the copying paper sheet 13. The copying paper sheet 13 on which the toner image is transferred is separated from the surface of the photosensitive drum 9 by means of a separation tape 19 and the separation charger 20. The copying paper sheet is then turned by a turn roller 21 and led to heat rollers 23 as a fixer through a guide path 22, so that the transferred image on the copying paper sheet is fixed. The copying paper sheet 13 is then delivered to a delivery tray 25 by a delivery roller 24. On the other hand, the photosensitive drum 9 after the transfer operation is performed is discharged by applying an electric charge whose polarity is opposite to that of the photosensitive drum 9 by the discharger 26. Thereafter, the toner which remains on the photosensitive drum 9 is removed by the cleaner 27, thus restoring the photosensitive drum 9 to initial status.

Figure 3A:
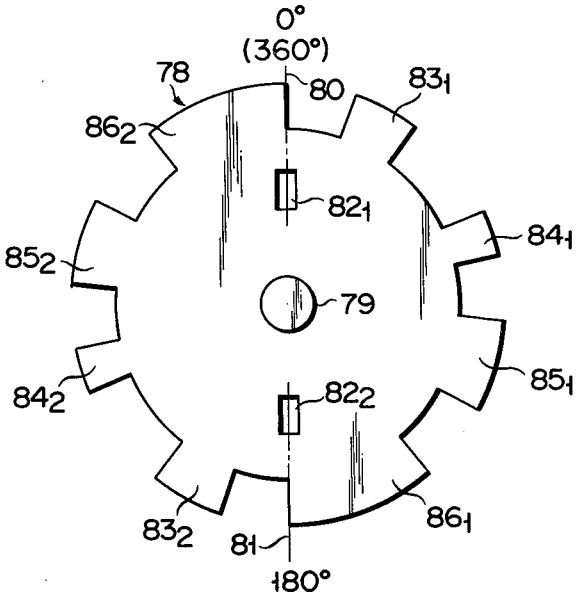
Figure 3B:
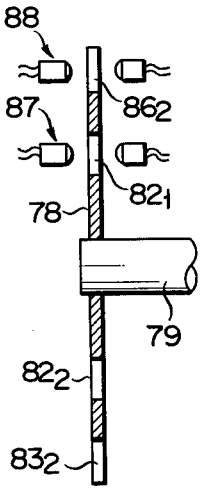

FIGS. 3A and 3B show a timing disc 78 which selects signals which are required for the copying operation according to the present invention. The timing disc 78 is directly coupled coaxially with the rotating shaft of the photosensitive drum 9 of FIG. 2 through a rotating shaft 79. It is assumed that a line 80 along the radial direction is at 0 degrees (360 degrees) and a line 81 is at 180 degrees. Signal apertures $\mathbf{82_1}$ and $\mathbf{82_2}$ are respectively formed at positions corresponding to 0 degrees and 180 degrees. The signal apertures $\mathbf{82_1}$ and $\mathbf{82_2}$ are formed to obtain reset pulses which indicate the angular positions of the timing disc 78 (angular positions of the photosensitive drum 9). Signal plates $\mathbf{83_1}$, $\mathbf{84_1}$, $\mathbf{85_1}$, and $\mathbf{86_1}$ and signal plates $\mathbf{83_2}$, $\mathbf{84_2}$, $\mathbf{85_2}$ and $\mathbf{86_2}$ respectively radially extend from the periphery of the timing disc 78. The adjacent signal plates form predetermined angles therebetween with respect to the 0 and 180 degree positions. In this case, as is apparent from FIG. 3A, the signal plates $\mathbf{83_1}$, $\mathbf{84_1}$, $\mathbf{85_1}$ and $\mathbf{86_1}$ and the signal plates $\mathbf{83_2}$, $\mathbf{84_2}$, $\mathbf{85_2}$ and $\mathbf{86_2}$ are symmetrically arranged on the outer periphery of the timing disc 78. These signal plates $\mathbf{83_1}$ to $\mathbf{86_1}$ and $\mathbf{83_2}$ to $\mathbf{86_2}$ are arranged to obtain timing signals for actual control operation. A detecting unit 87 for reset signals is arranged in the vicinity of the periphery of the timing disc 78 to detect optically the signal apertures $\mathbf{82_1}$ and $\mathbf{82_2}$. Further, a detecting unit 88 for timing signals is arranged in the vicinity of the timing disc 78 to detect optically the signal plates $\mathbf{83_1}$ to $\mathbf{86_1}$ and $\mathbf{83_2}$ to $\mathbf{86_2}$.

Figure 4:
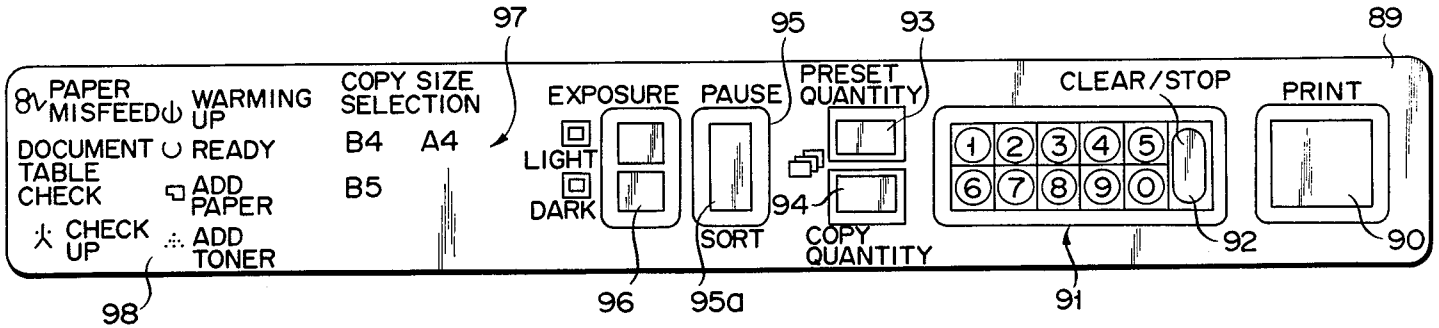
FIG. 4 is a plan view of a control panel of the electronic copying machine of FIG. 1.

FIG. 4 shows the control panel of the electronic copying machine as described above. The control panel comprises a panel main body 89, a copying key 90, numeric keys 91 for setting the preset sheet number, a clear/stop key 92, a preset sheet number display unit 93 which digitally displays the preset sheet number, a copying sheet number display unit 94 which displays the actual number of copying paper sheets copied, an interrupt key 95 which specifies the interrupt mode of copying, an interrupt display lamp **95*a* which is arranged at the top of the interrupt key 95, a toner concentration setting key 96 which specifies the concentration of an image of the document, a copy size selection section 97 which displays paper size, and a state display section 98**.

Figure 5A:
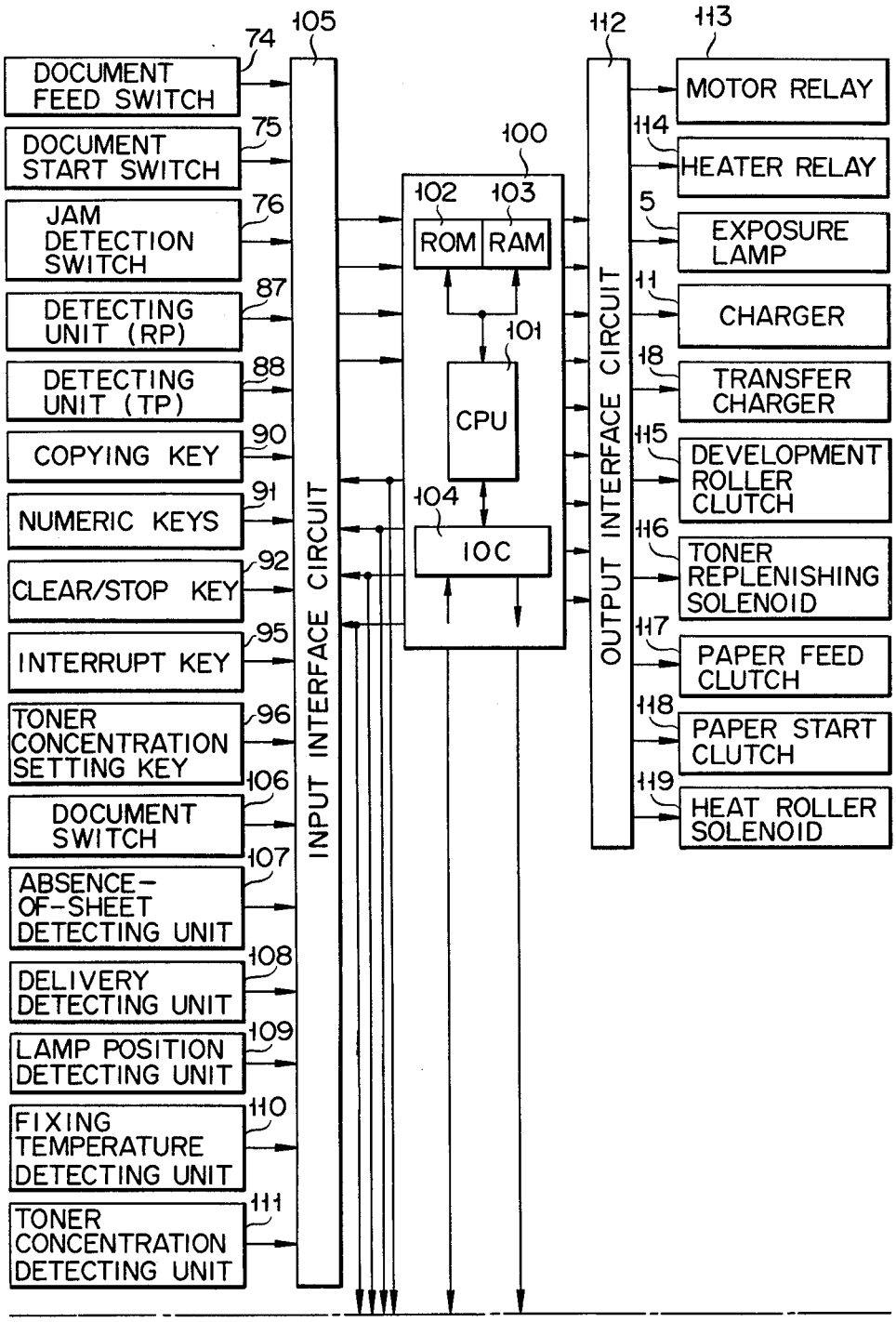
FIGS. 5A and 5B are block diagrams schematically showing the control system of the electronic copying machine as shown in FIG. 2.
Figure 5B:
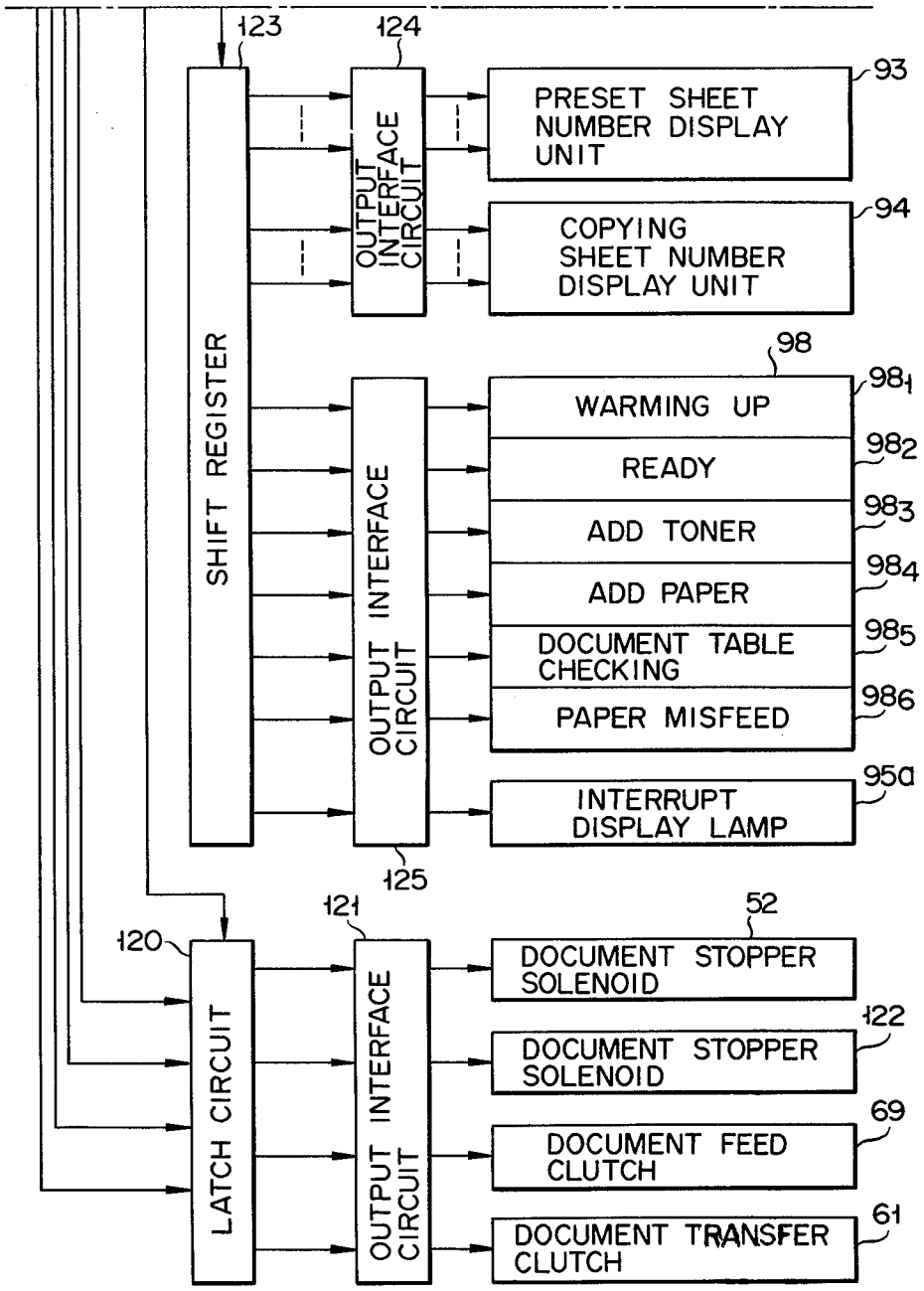

FIGS. 5A and 5B schematically show the control system. A microprocessor 100 comprises a central processing unit 101 (to be referred to as a "CPU" hereinafter) which controls the overall sequence operation; a read-only memory 102 (to be referred to as a "ROM" hereinafter) which stores operation sequence programs for a copying operation section which performs copying processes such as document feeding, paper feeding and transferring, discharging, exposure, development, and fixing; a random access memory 103 (to be referred to as a "RAM" hereinafter) which stores data which is required in the CPU 101; and an input/output control unit 104 (to be referred to as "IOC" hereinafter) which controls input and outputs of signals and data. An input interface circuit 105 for selecting an input is connected to the microprocessor 100. To the input interface circuit 105 are connected a document feed switch 74, a document start switch 75, a jam detection switch 76, the detecting units 87 and 88, the copying key 90, the numeric keys 91, the clear/stop key 92, the interrupt key 95, the toner concentration setting key 96 and so on. Further, to the input interface circuit 105 are connected a document switch 106 which is turned on when the automatic document feeder 3 is closed; copying sheet quantity detecting means for detecting if the amount of the copying paper sheets 13 in the paper supply cassette 14 is lower than a predetermined amount, for example, an absence-of-sheet detecting unit 107 which detects the absence of the copying paper sheets 13; a delivery detecting unit 108 which detects the delivery of the copying paper sheet 13 from the delivery tray 25; a lamp position detecting unit 109 which detects the position of the exposure lamp 5; a fixing temperature detecting unit 110 which detects the fixing temperature of the heat rollers 23; and a toner concentration detecting unit 111 which detects the toner concentration in the developing unit 12. The input interface circuit 105 selects a group of inputs which are supplied from each switch or key in response to a selection signal of 8421 code which is supplied from the microprocessor 100. The selected inputs are converted to a binary code of "1" and "0" and the converted signal is input to the microprocessor 100.

An output interface circuit 112 which drives periphery units is connected to the microprocessor 100. The exposure lamp 5, the charger 11, the transfer charger 18, and so on are connected to the output interface circuit 112. To this output interface circuit 112 are also connected the discharge lamp 10, the separation charger 20, the discharger 26, a motor relay 113 which controls the on/off switch of a motor 28, a heater relay 114 which controls the heater of the heat rollers 23, a developing roller clutch 115 which controls the developing roller of the developing unit 12, a toner replenishing solenoid 116 which controls the toner replenishing roller of the developing unit 12, a paper feed clutch 117 which controls the paper feed roller 15, a paper start clutch 118 which controls the aligning rollers 17, and a heat roller solenoid 119 which controls the pressure roller section of the heat rollers 23.

The output interface circuit 112 controls the periphery units in response to various control signals which are supplied from the microprocessor 100.

A latch circuit 120 is connected to the microprocessor 100. To the latch circuit 120 are connected a document stopper solenoid 52, a document feed clutch 69, a document transfer clutch 61 and a document stopper solenoid 122 which controls the document stopper 40 through an output interface circuit 121 which drives the periphery units.

Further, a shift register 123 for display is connected to the microprocessor 100. The preset sheet number display unit 93 and the copying sheet number display unit 94 are both connected to the shift register 123 through the output interface circuit 124 for driving the display units. Further, the interrupt display lamp **95*a* and the state display section 98 are both connected to the shift register 123 through an output interface circuit 125** for driving the display units.

The general mode of operation of exchange of data or signals in the microprocessor 100 will be described. The CPU 101 sequentially reads out programs which are stored in the ROM 102 and performs the sequence control. Along with this operation, the CPU 101 performs necessary input/output control operations. The exchange of various data or signals which are required between the CPU 101 and each copying processing unit or the control panel is performed through the IOC 104, the input interface circuit 105 and the output interface circuit 112. The CPU 101 reads the status signal or data from each processing unit and the control panel in the IOC 104 through the input interface circuit 105 in response to a program read out from the ROM 102. The read-in data is judged so as to execute the program. Based on the obtained result, various control signals or data are supplied to the output interface circuit 112, the shift register 123 and the latch circuit 120 through the IOC 104. The CPU 101 operates various pieces of data within itself, and stores data obtained by these operations in the RAM 103. Further, the data which is stored in the RAM 103 is read out as needed.

The control system which uses the timing disc 78 will be described. According to the present invention, the operations which are required for the copying operation are all based on the position of the optical system, that is, on the position of the timing disc 78 which is directly coupled to the photosensitive drum 9 as the reference. When the photosensitive drum 9 starts rotating, the timing disk 78 rotates accordingly. In this embodiment, the photosensitive drum 9 rotates two and one-half times for single copying. Therefore, the timing disc 78 rotates two and one-half times. Since the timing disc 78 has the shape as described above, a timing signal (to be described as a "reset pulse RP" hereinafter) as shown in FIG. 6A is detected by the detecting unit 87 every time the timing disc 78 rotates one-half time. The detecting unit 88 detects a timing signal TP as shown in FIG. 6B. In response to the reset pulse RP and the timing signal TP, the microprocessor 100 performs various copying operations at timings of the timing signal TP with reference to the reset pulse RP. In particular, transition points (leading and trailing edges) T0 to T7 of the timing signal TP are sequentially judged with reference to the reset pulse RP as shown in FIGS. 6B to 6E, and one cycle is performed at timings of the transition points T0 to T7 of the timing signal TP every time the reset pulse RP is detected. In this embodiment, five cycles are performed for single copying. For example, assume that a 0th cycle corresponds to one-half revolution of the timing disc 78 a first cycle corresponds to one revolution of the timing disc 78, a second cycle corresponds to one and one-half revolutions of the timing disc 78, a third cycle corresponds to two revolutions of the timing disc 78, and a fourth cycle corresponds to two and one-half revolutions of the timing disc 78. Process 0 is performed in the 0th cycle, process 1 is performed in the first cycle, process 2 is performed in the second cycle, process 3 is performed in the third cycle, and process 4 is performed in the fourth cycle. In order to judge how many cycles are performed from the beginning, a shift register is arranged whose number of bits corresponds to the number of cycles. Since there are five cycles in this embodiment, a shift register SR of four bits (first to fourth bits SR0 to SR3) is arranged in a specified area of the RAM 103 of FIG. 5A. When the cycle is initiated, the first bit SR0 of the shift register SR is set. In every cycle, the content of the shift register SR is shifted, so that the first bit SR0 is set to "1" in the first cycle and the second bit SR1 is set to "1" in the second cycle. In this manner, in every cycle, the content of the shift register SR is shifted in accordance with the sequence of the cycle. When the first bit SR0 is set to "1", process 1 of the first cycle is performed. When the second bit SR1 is set to "1", process 2 of the second cycle is performed. This sequential operation is performed in the same manner as described above.

Figures 8, 9:
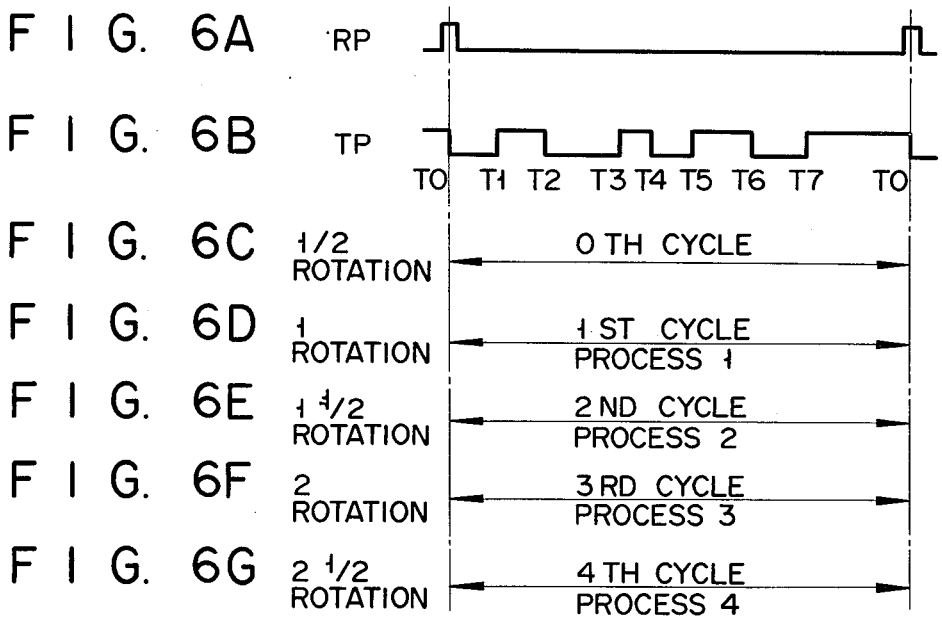
FIG. 8 is a table for explaining the relation between each process and the corresponding shift register in single copying in the electronic copying machine of FIG. 2.
FIG. 9 is a table for explaining the relation between each process and the corresponding shift register in double copying.
Figures 7A, 7B:
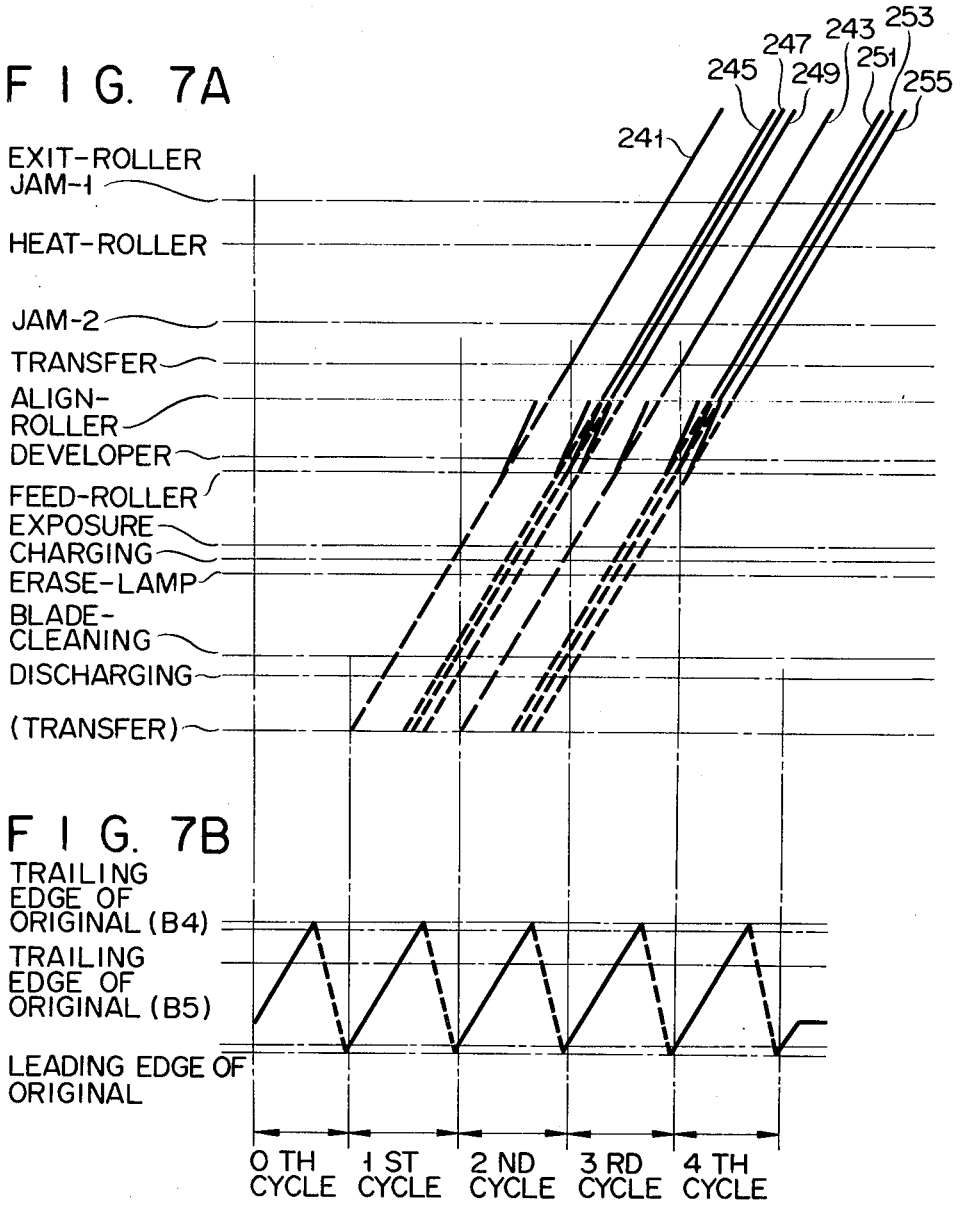
Figure 10A:
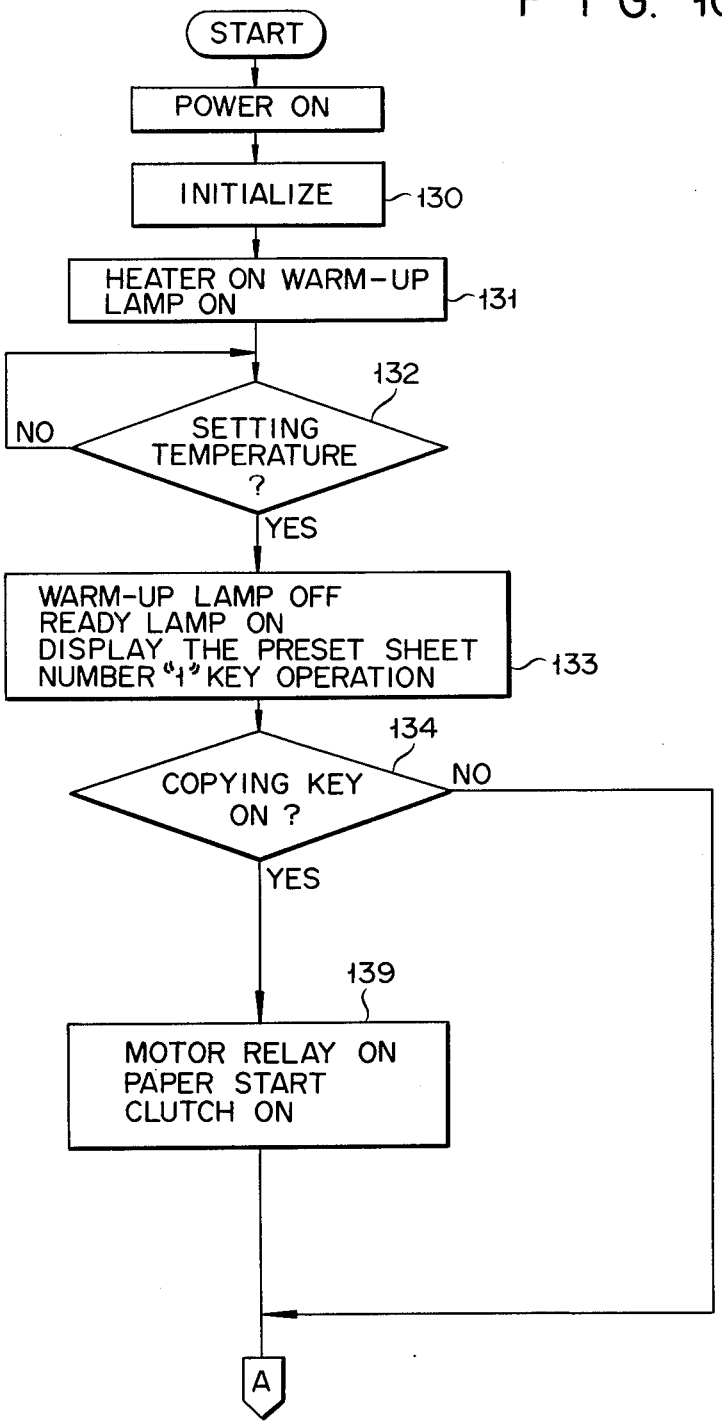
FIGS. 10A to 10I are flow charts for explaining the sequence control of the electronic copying machine according to the present invention when processes corresponding to the respective cycles as shown in FIGS. 6C to 6G are performed in series.
Figure 10B:
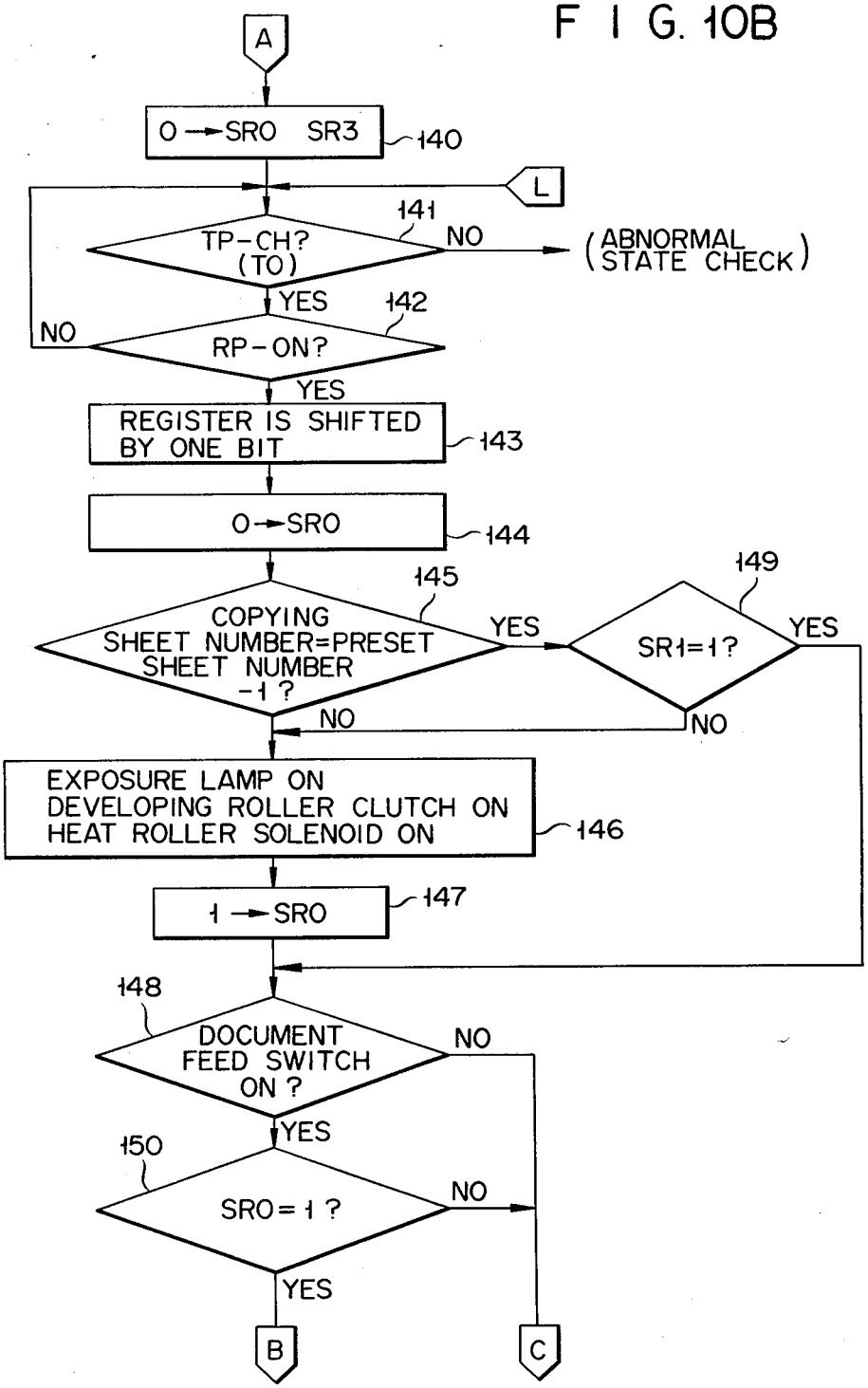
Figure 10C:
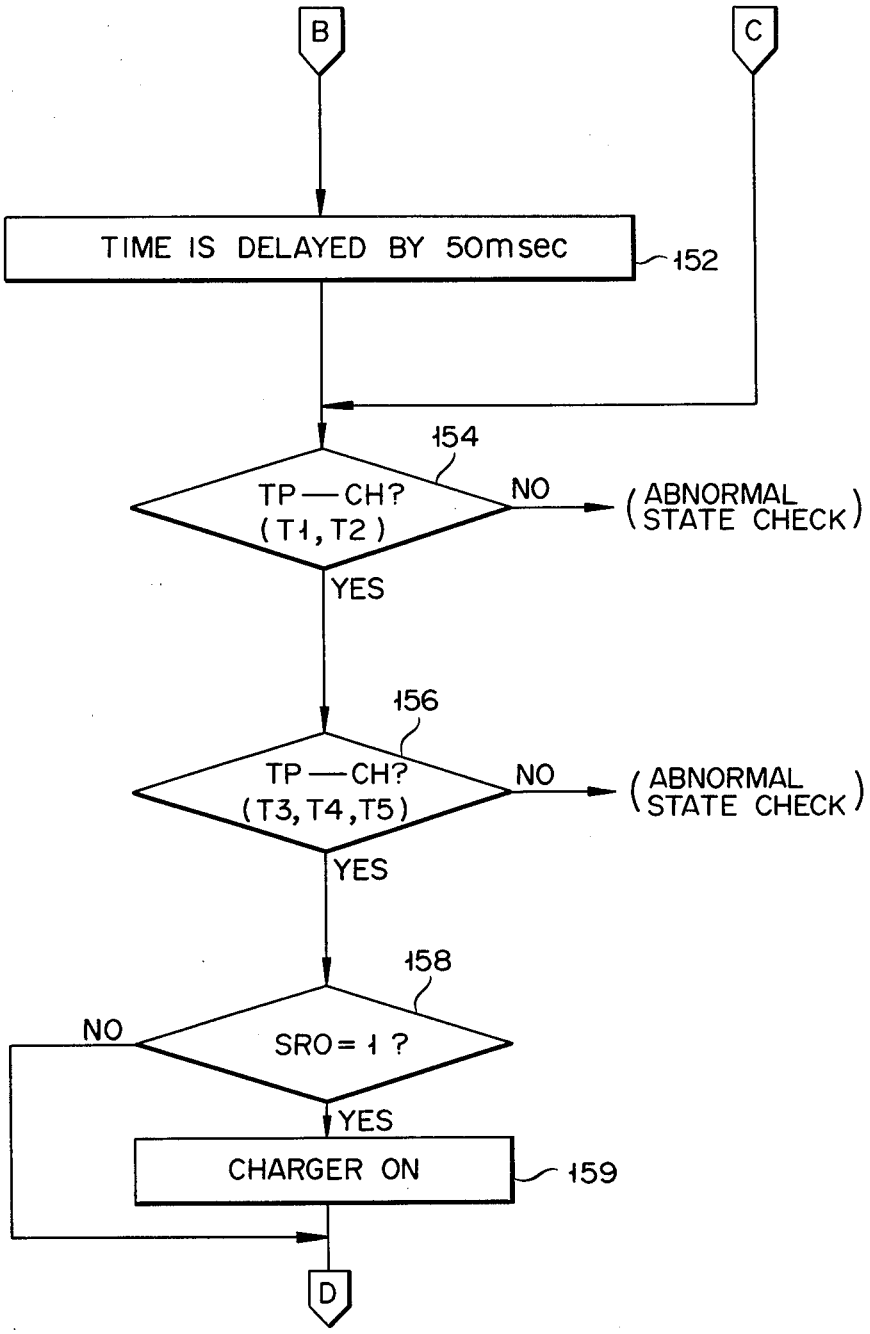
Figure 10D:
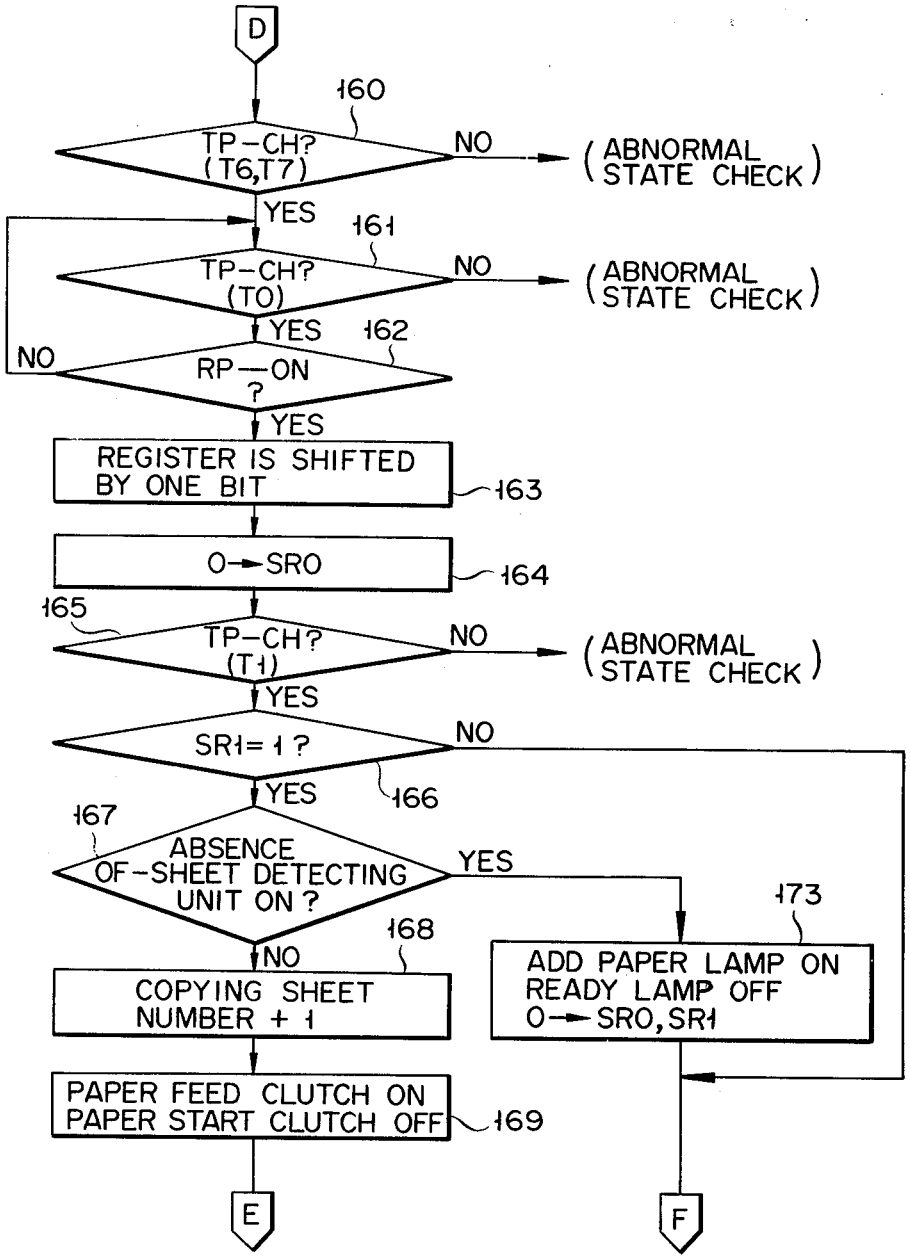
Figure 10E:
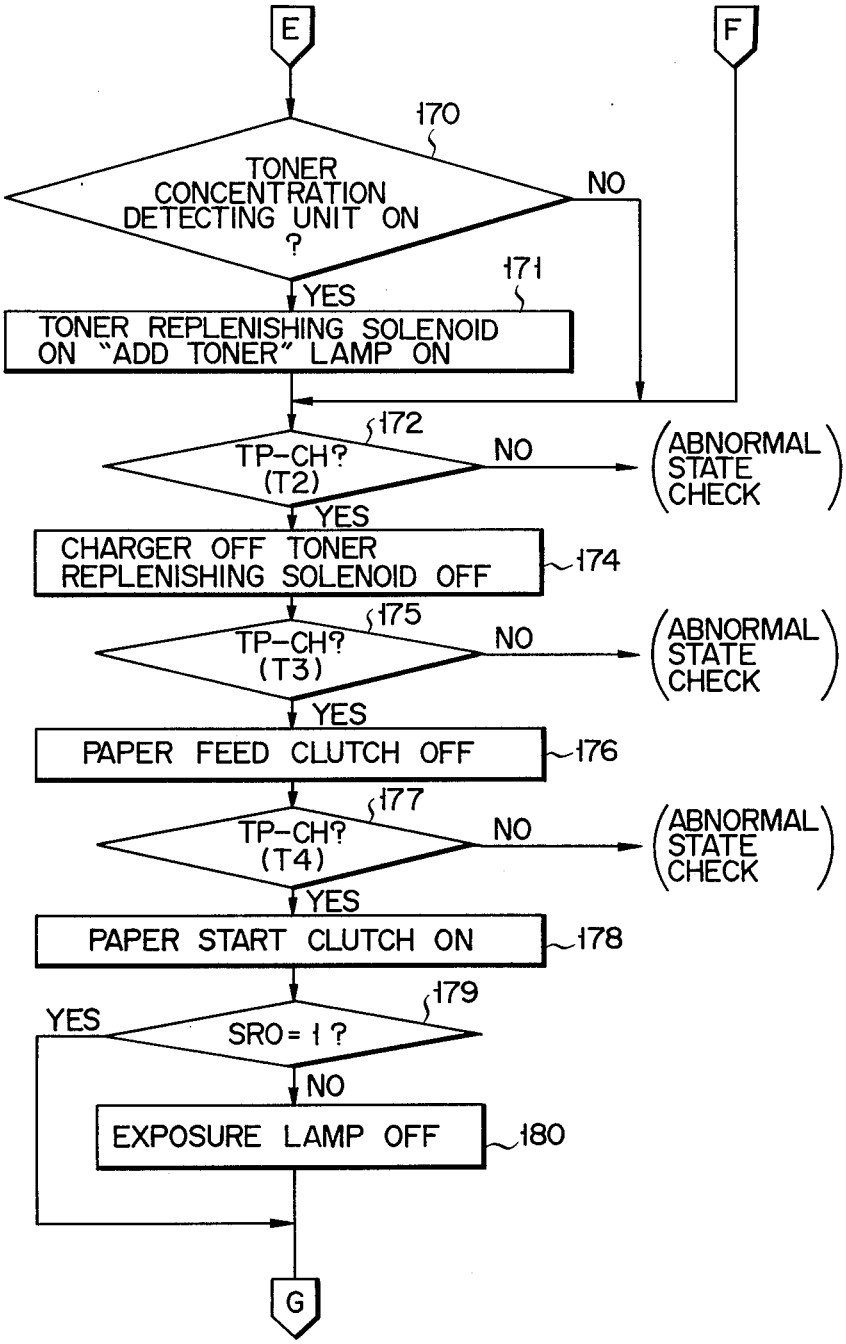
Figure 10F:
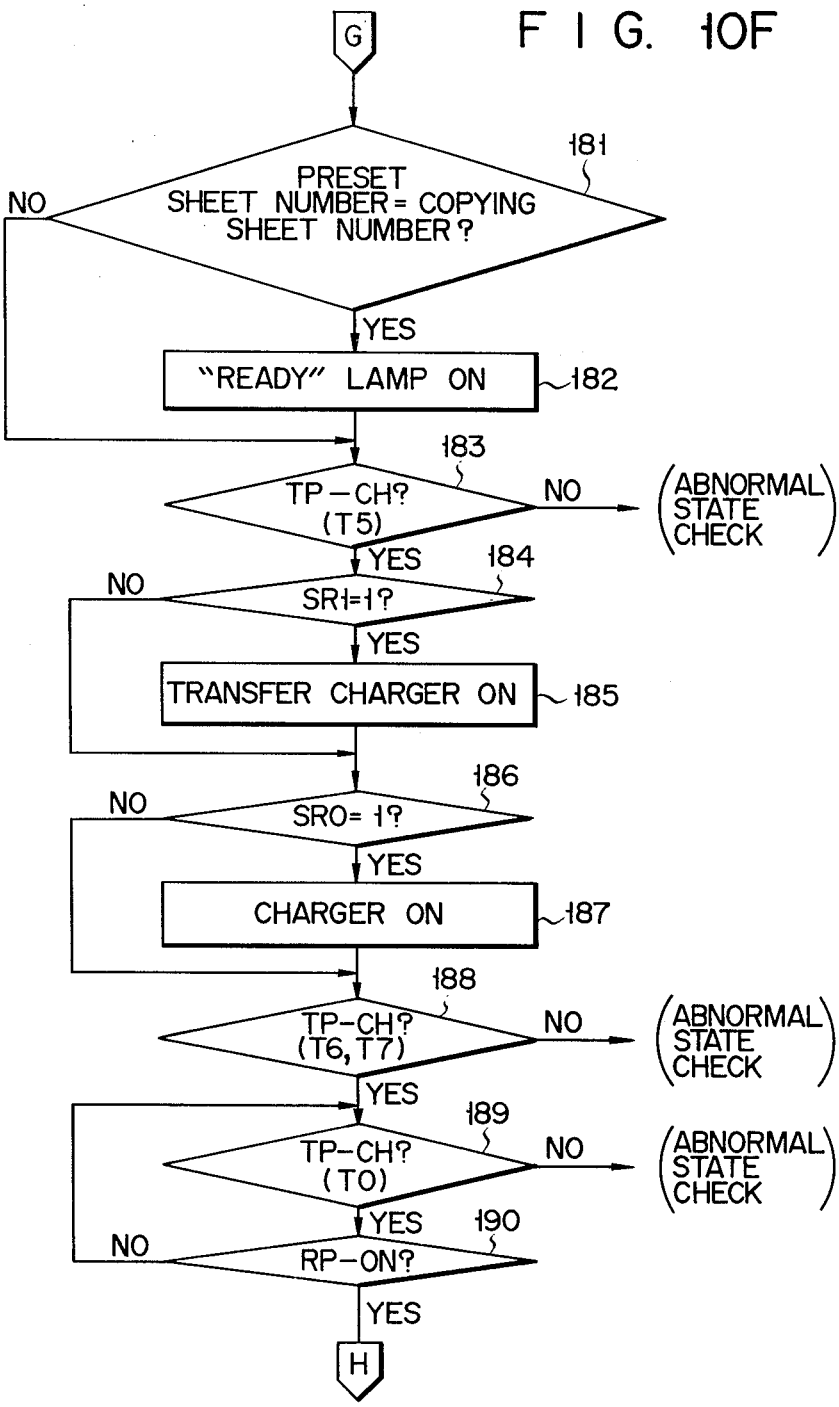
Figure 10G:
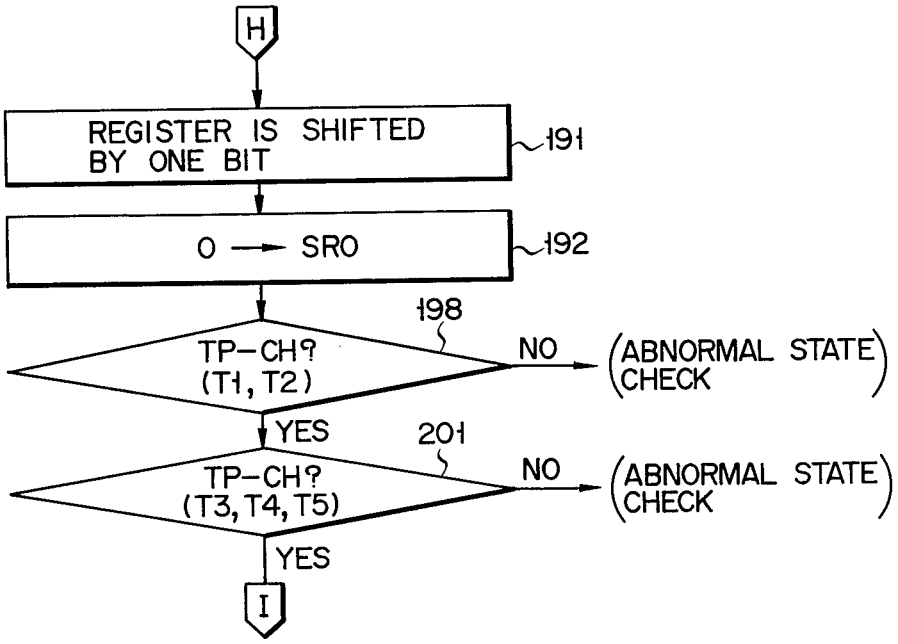
Figure 10H:
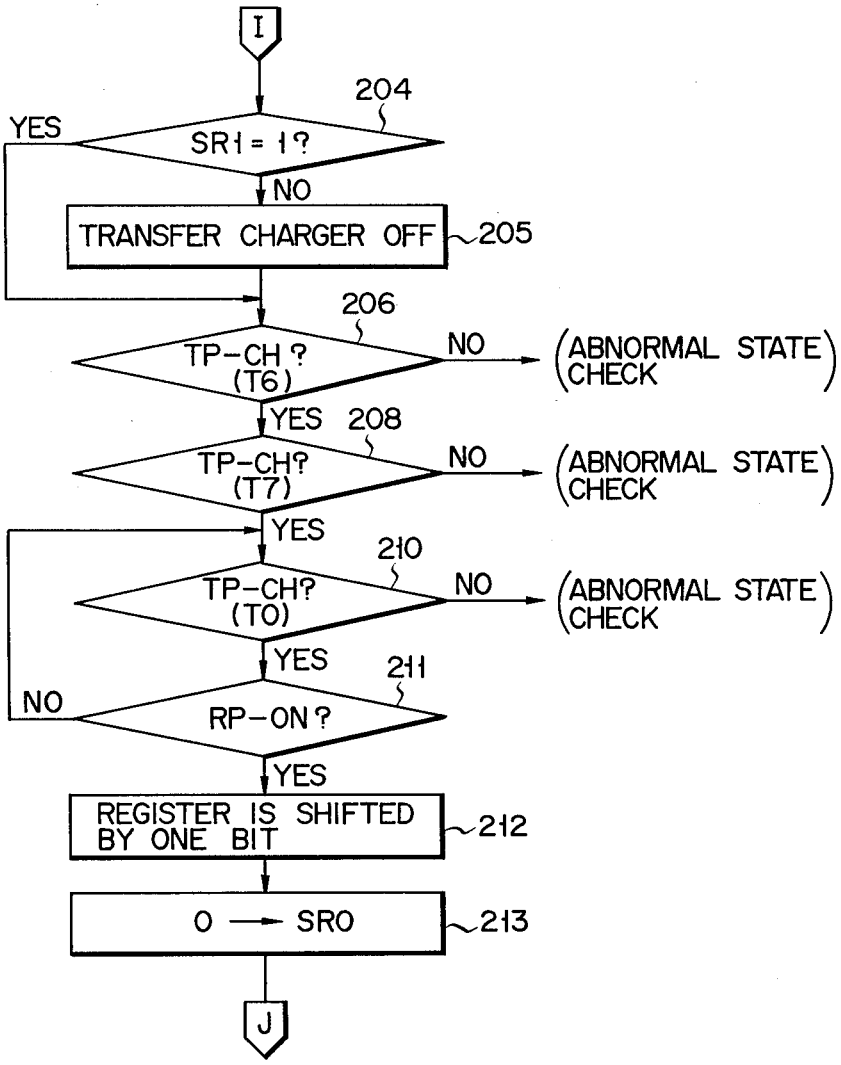
Figure 10I:
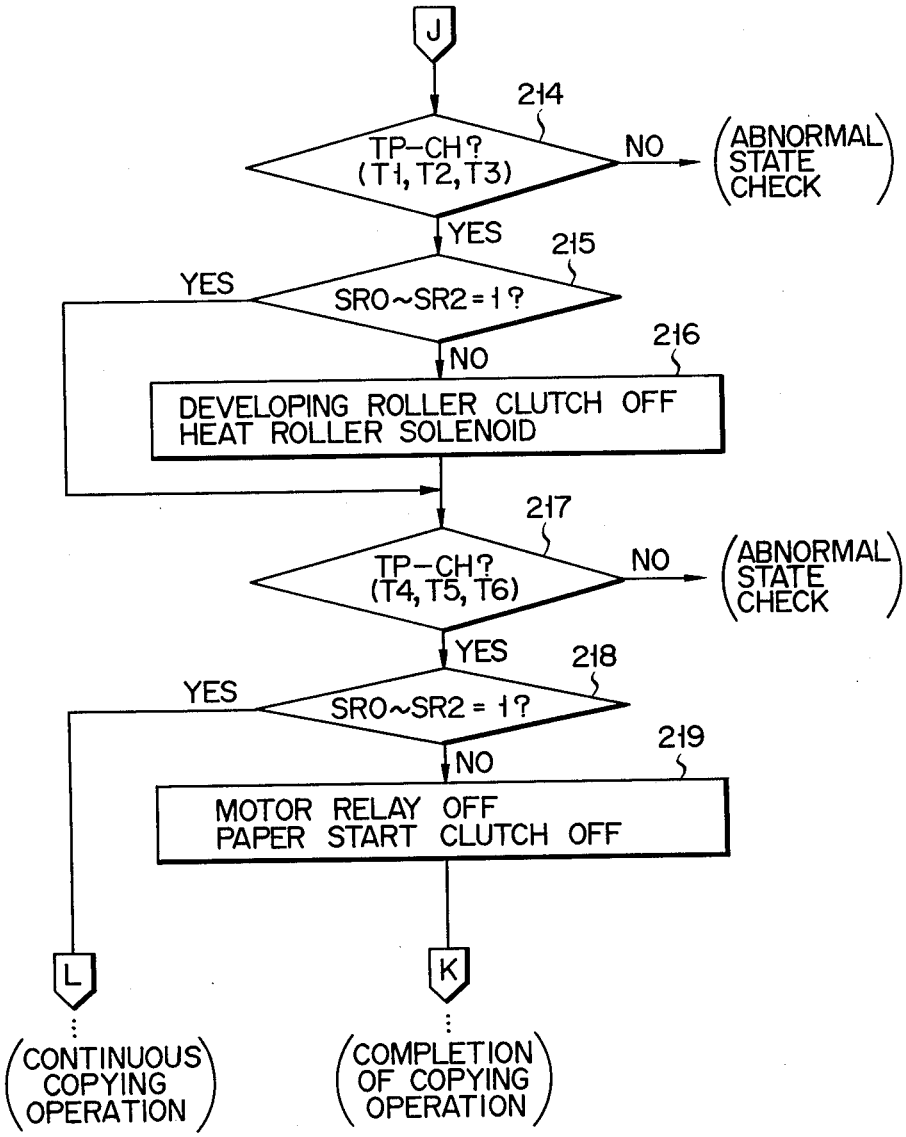

FIGS. 7A and 7B are timing charts for explaining the timings and the corresponding processes in the electronic copying machine according to the present invention. FIG. 7A shows timings of processes such as transfer, discharging, blade cleaning, erase lamp, charging, exposure, feed roller, developer, aligning roller, transfer, heat roller and exit roller processes. FIG. 7B shows timings of reciprocal movement of the document table. Timings shown in FIGS. 7A and 7B correspond to the respective processing cycle as shown in FIGS. 6C to 6G. Referring to FIG. 7A, the broken lines denote the timing of each process on the side of the photosensitive drum 9, and the solid lines denote the timing of each process after the copying paper sheet is fed. Oblique line 241 indicates the leading end of the first copying paper sheet and oblique line 243 indicates the leading end of the second copying paper sheet. Oblique lines 245, 247 and 249, respectively, indicate the trailing ends of the first copying paper sheets when paper size of B5, A4 and B4 is used. Oblique lines 251, 253 and 255, respectively, indicate the trailing ends of the second copying paper sheets when paper size of B5, A4 and B4 is used. Short solid lines 257 which are located substantially at the center of oblique lines 241, 245, 247, 249, 243, 251, 253, and 255 indicate the waiting time for feeding the copying paper sheet at the aligning rollers. Further, the solid lines as shown in FIG. 7B indicate the forward movement of the document table and the broken lines indicate the reverse movement of the document table. As is apparent from these figures, the document is substantially read in the second cycle when the exposure operation is initiated. FIG. 8 shows the relation between each cycle and the register SR in single copying and FIG. 9 shows the relation between each cycle and the resistor SR in double copying (continuous copying operation).

The sequence control of the copying operation according to the present invention will be described with reference to the flow charts in FIGS. 10A to 10I. When a power switch (not shown) is turned on, the CPU 101 "initializes" the copying mode in step 130. The program advances to step 131. The heater relay 114 is turned on in step 131, and power is supplied to the heaters of the heat rollers 23 so that the heaters start heating. The program advances to step 132. In this condition, a warm-up lamp $98_1$ of the state display section 98 is lit. It is checked in step 132 whether or not the temperature of the heat rollers 23 has reached the predetermined value. When the temperature reaches the predetermined value, the heater relay 114 is turned off. Then, the program advances to step 133. After the temperature of the heat rollers 23 reaches the predetermined value, the heater relay 114 repeats the on/off operation in accordance with the temperature of the heat rollers 23, so that the heat rollers 23 are maintained at a constant temperature. The warm-up lamp $98_1$ is turned off in step 133. On the other hand, a ready lamp $98_2$ of the state display section 98 is turned on and the count value "1" is displayed at the preset sheet number display unit 93. Therefore, the respective keys on the control panel are ready to be used. In step 133, the count value "1" is displayed at the preset sheet number display unit 93, or the program advances to step 134 when the numeric keys 91 are depressed. It is checked in step 134 whether or not the copying key 90 is depressed. In this case, as the copying key 90 is not depressed yet, the program advances to step 140. On the other hand, in the ready status, if the copying key 90 is depressed, the program advances to step 139. The motor relay 113 and the paper start clutch 118 are turned on in step 139 and the copying operation to be described later is performed. The shift register SR is cleared in step 140 and the program advances to step 141. The timing signal TP is checked in step 141 (TP-CH) to detect the transition point T0 and the program advances to step 142. On the other hand, if the transition point T0 is not detected in step 141, the program advances to the check routine of abnormal status and the electronic copying machine stops operating. When the transition points are not detected in the timing signal TP checking (TP-CH) in the following operation, the same operation as described above is performed so that the detailed description thereof will be omitted. The reset pulse RP is detected (RP-ON) in step 142. If the timing signal RP is not detected in step 142, the program returns to step 141 so that steps 141 and 142 are repeated again. When the reset pulse RP is detected, the program advances to 143. The register SR is shifted by one bit in step 143 and the program advances to step 144. The signal "0" is set in the first bit SR0 of the shift register SR in step 144 and the program advances to 145. The relation "copying sheet number = preset sheet number − 1" is checked in step 145. If the left side is not equal to the right side in the above relation, the program advances to step 146. The exposure lamp 5, the developing roller clutch 115 and the heat roller solenoid 119 are turned on in step 146, and the program advances to step 147. When the developing roller clutch 115 is turned on, the developing magnet roller starts rotating, the heat roller solenoid 119 is turned on, and the pressure roller sections of the heat rollers 23 come in contact with the heat roller section. The signal "1" is set in the first bit SR0 of the shift register SR in step 147 and the program advances to step 148. On the other hand, in step 145, if the "preset sheet number" equals the "copying sheet number − 1", the program advances to step 149. It is checked in step 149 whether or not the second bit SR1 of the shift register SR is set to "1". If the second bit SR1 is set to "1", the program jumps to step 148 skipping steps 146 and 147. It is checked in step 148 whether or not the document feed switch 74 is turned on. If the document feed switch is turned on, the program advances to step 150. It is checked in stpe 150 whether or not the first bit SR0 of the shift register SR is set to "1". If the first bit SR0 is set to "1", the program advances to step 152. A time delay of 50 msec is generated in step 152, and the program advances to step 154. On the other hand, if the document feed switch 74 is not turned on in step 148, the program jumps to step 154 skipping steps 150 and 152. The timing signal TP is checked in step 154 to sequentially detect the transition points T1 and T2. If the transition point T1 is detected, the program advances to step 156. The timing signal TP is checked in step 156 to sequentially detect the transition points T3, T4 and T5. When the transition point T5 is detected, the program advances to step 158. It is checked in step 158 whether or not the first bit SR0 of the shift register SR is set to "1". If the first bit SR0 of the shift register SR is set to "1", the program advances to step 159. The charger 11 is turned on in step 159 and the program advances to step 160. When the charger 11 is turned on, the surface of the photosensitive drum 9 is electrically charged and the exposure operation is initiated. On the other hand, if the first bit SR0 of the shift register SR is not set to "1" in step 158, the CPU judges that the charger 11 should not be turned on. Therefore, the program jumps to step 160 skipping step 159. The timing signal TP is checked to sequentially detect the transition points T6 and T7 in step 160. When the transition point T7 is detected, the program advances to step 161. The timing signal TP is checked again in step 161 to detect the transition point T0. If the transition point T0 is detected, the program advances to step 162. The reset pulse RP is detected in step 162. If the reset pulse RP is not detected in step 162, the program returns to step 161, and steps 161 and 162 are repeated again. If the reset pulse RP is detected in step 162, the program advances to step 163. The shift register SR is shifted by one bit in step 163, and the program advances to step 164. When the shift register SR is shifted by one bit, the second bit SR1 of the shift register SR is set to "1". The first bit SR0 of the shift register SR is set to "0" in step 164, and the program advances to step 165.

The timing signal TP is checked in step 165 to detect the transition point T1, and the program advances to step 166. It is checked in step 166 whether or not the second bit SR1 of the shift register SR is set to "1". If the second bit SR1 of the shift register SR is set to "1", the program advances to step 167. It is checked in step 167 whether or not the absence-of-sheet detecting unit 107 is turned on. If it is not turned on, the program advances to step 168. The count content of the copying sheet number display unit 94 is incremented by 1 in step 168, and the program advances to step 169. The paper feed clutch 117 is turned on in step 169, the paper start clutch 118 is turned off, and the program advances to step 170.

When the paper feed clutch 117 is turned on, the paper feed roller 15 starts rotating so that the copying paper sheet is fed. When the paper start clutch 118 is turned off, the aligning rollers 17 stop rotating. It is checked in step 170 whether or not the toner concentration detecting unit 111 is turned on. If it is turned on, the program advances to step 171. The toner replenishing solenoid 116 and the toner replenishing lamp $98_3$ of the state display section 98 are turned on. The program advances to step 172. When the toner replenishing solenoid 116 is turned on, a predetermined amount of toner is replenished in the developing unit 12. On the other hand, if the toner concentration detecting unit 111 is not turned on in step 170, the toner replenishing operation is not required, so that the program jumps to step 172 skipping step 171. Further, when the second bit SR1 of the shift register SR is not set to "1" in step 166, the CPU judges that the copying paper sheet should not be fed, so that the program jumps to step 172 skipping steps 167 to 171. When the absence-of-sheet detecting unit 107 is turned on in step 167, the copying paper sheets are not present in the paper feed cassette and the paper feeding cannot be performed, so that the program advances to step 173. The ready lamp $98_2$ of the state display section 98 is turned off and an add paper lamp $98_4$ is turned on. Further, the signal "0" is set in the first and second bits SR0 and SR1 of the shift register SR, and the program advances to step 172. The timing signal TP is checked in step 172 to detect the transition point T2 and the program advances to step 174. The charger 11 and the toner replenishing solenoid 116 are turned off in step 174, and the program advances to step 175.

The timing signal TP is checked in step 175 to detect the transition point T3 and the program advances to step 176. The paper feed clutch 117 is turned off in step 176, and the program advances to step 177. When the paper feed clutch 117 is turned off, the copying paper sheet 13 temporarily stops at the aligning rollers 17. The timing signal TP is checked in step 177 to detect the transition point T4 and the program advances to step 178. The paper start clutch 118 is tured on in step 178, and the program advances to step 179. When the paper start clutch 118 is turned on, the aligning rollers 17 start operating so that the copying paper sheet 13 which is temporarily stopped is transferred to the transfer section. The leading end of the photosensitive drum 9 and the leading end of the copying paper sheet 13 are synchronously aligned. It is checked in step 179 whether or not the first register SR0 of the shift register SR is set to "1". If the first register SR0 is not set to "1", the program advances to step 180. The exposure lamp is turned off in step 180, and the program advances to step 181. On the other hand, if the first bit SR0 of the shift register SR is set to "1" is step 179, the program jumps to step 181 skipping step 180 since the CPU judges that the exposure lamp 5 should not be turned off. It is checked in step 181 whether or not the preset sheet number is equal to the copying sheet number. If the preset sheet number is equal to the copying sheet number, the program advances to step 182. The ready lamp $98_2$ is turned on in step 182, and the program advances to step 183. The electronic copying machine is ready for a next document 41. When the preset sheet number is not equal to the copying sheet number in step 181, the copying operation is not completed so that the program advances to step 183.

The timing signal TP is checked in step 183 to detect the transition point T5 and the program advances to step 184. It is checked in step 184 whether or not the second bit SR1 of the shift register SR is set to "1". If it is set to "1", the program advances to step 185. The transfer charger 18 is turned on in step 185 and the program advances to step 186. When the transfer charger 18 is turned on, the toner image formed on the photosensitive drum 9 is transferred to the copying paper sheet 13. If the second bit SR1 of the shift register SR is not set to "1" in step 184, the CPU judges that the transfer operation should not be performed, so that the program jumps to step 186 skipping step 185. It is checked in step 186 whether or not the first bit SR0 of the shift register SR is set to "1". If it is set to "1", the program advances to step 187. The charger 11 is turned on in step 187 and the program advances to step 188. The charging operation for the next copying paper sheet in continuous copying is performed in step 187. If the first bit SR0 of the shift register SR is not set to "1" is step 186, the CPU judges that the charging operation should not be performed, so that the program jumps to step 188 skipping step 187. The timing signal TP is checked in step 188 to sequentially detect the transition points T6 and T7. When the transition point T7 is detected, the program advances to step 189. The timing signal TP is checked in step 189 to detect the transition point T0 and the program advances to step 190. The reset pulse RP is detected in step 190. When the reset pulse RP is not detected, the program returns to step 189 and steps 189 and 190 are repeated again. When the reset pulse RP is detected, the program advances to step 191. The shift register SR is shifted by one bit in step 191, and the program advances to step 192. In this condition, since the shift register SR is shifted by one bit, the third bit SR2 of the shift register SR is set to "1". The signal "0" is set in the first bit SR0 of the shift register SR in step 192 and the program advances to step 198. The timing signal TP is checked in step 198 to sequentially detect the transition points T1 and T2. When the transition point T2 is detected, the program advances to step 201.

The timing signal TP is checked in step 201 to sequentially detect the transition points T3 and T4. When the transition point T4 is detected, the program advances to step 204. It is checked in step 204 whether or not the second bit SR1 of the shift register SR is set to "1". If it is not set to "1", the program advances to step 205. The transfer charger 18 is turned off in step 205, and the program advances to step 206. However, if the second bit SR1 of the shift register SR is set to "1" in step 204, the CPU judges that the transfer charger 18 should not be turned off, so that the program jumps to step 206 skipping step 205. The timing signal TP is checked in step 206 to detect the transition point T6 and the program advances to step 208.

The timing signal TP is checked in step 208 to detect the transition point T7 and the program advances to step 210. The timing signal TP is checked again in step 210 to detect the transition point T0 and the program advances to step 211. The reset pulse RP is detected in step 211. If it is not detected, the program returns to step 210, and steps 210 and 211 are repeated again. On the other hand, if the timing signal RP is detected, the program advances to step 212. The shift register SR is shifted again by one bit in step 212, and the program advances to step 213. Since the shift register SR is shifted by one bit, the signal "1" is set in the fourth bit SR3 of the shift register SR. The signal "0" is set in the first bit SR0 of the shift register SR in step 213, and the program advances to step 214. The timing signal TP is checked in step 214 to sequentially detect the transition points T1, T2 and T3. When the transition point T3 is detected, the program advances to step 215. It is checked in step 215 whether or not the first to third bits SR0 to SR2 of the shift register SR are set to "1". If all the bits SR0 to SR2 are not set to "1", the program advances to step 216. The developing roller clutch 115 and the heat roller solenoid 119 are turned off in step 216, and the program advances to step 217. When one or more of the bits SR0 to SR2 is set to "1" in step 215, the CPU judges that the developing roller clutch 115 and the heat roller solenoid 119 should not be turned off. Therefore, the program jumps to step 217 skipping step 216. The timing signal TP is checked in step 217 to sequentially detect the transition points T4, T5 and T6. When the transition point T6 is detected, the program advances to step 218. It is checked in step 218 whether or not the bits SR0 to SR2 of the shift register SR are set to "1". If they are not all set to "1", the CPU judges that the copying operation is completed, so that the program advances to step 219. The motor relay 113 and the paper start clutch 118 are turned off in step 219. The program then returns to step 133 so that the ready status is restored. When the motor relay 113, paper start clutch 118 and the document feed clutch 69 are turned off, the electronic copying machine stops the copying operation and is ready for the next copying operation. However, when any one of the bits SR0 to SR2 is set to "1" in step 218, the CPU judges that the continuous copying operation is not completed, so that the program returns to step 141 and the following steps are repeated again.

Figures 11A, 11B, 11C, 11D, 11E:
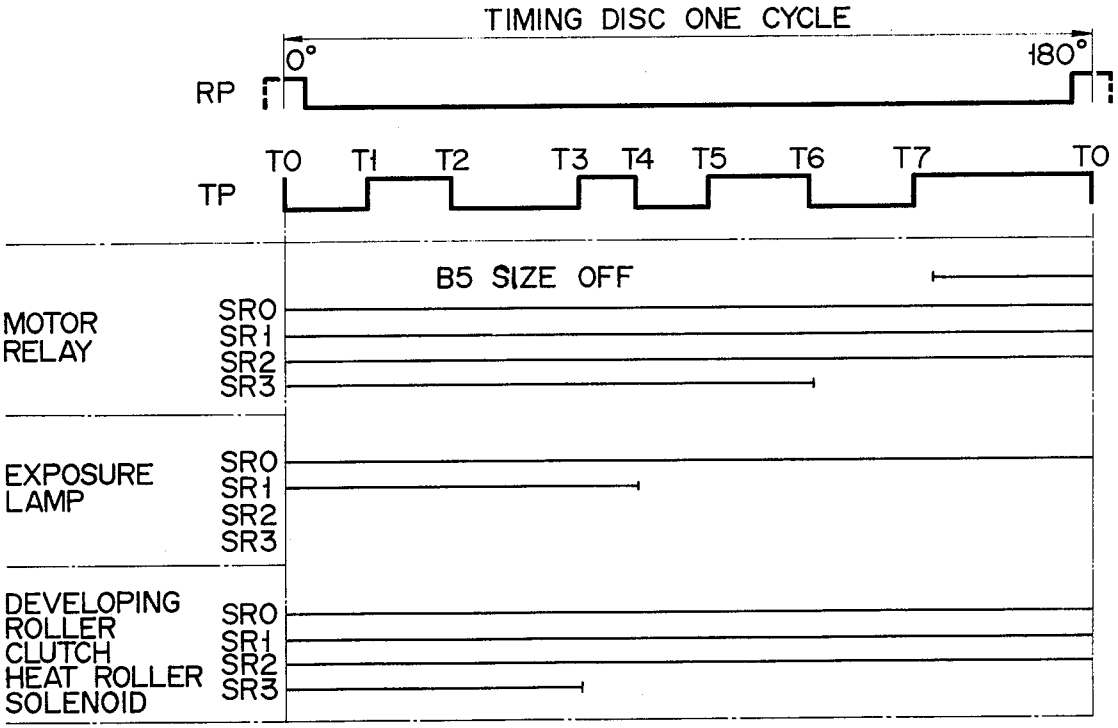
Figures 11F, 11G, 11H, 11I:
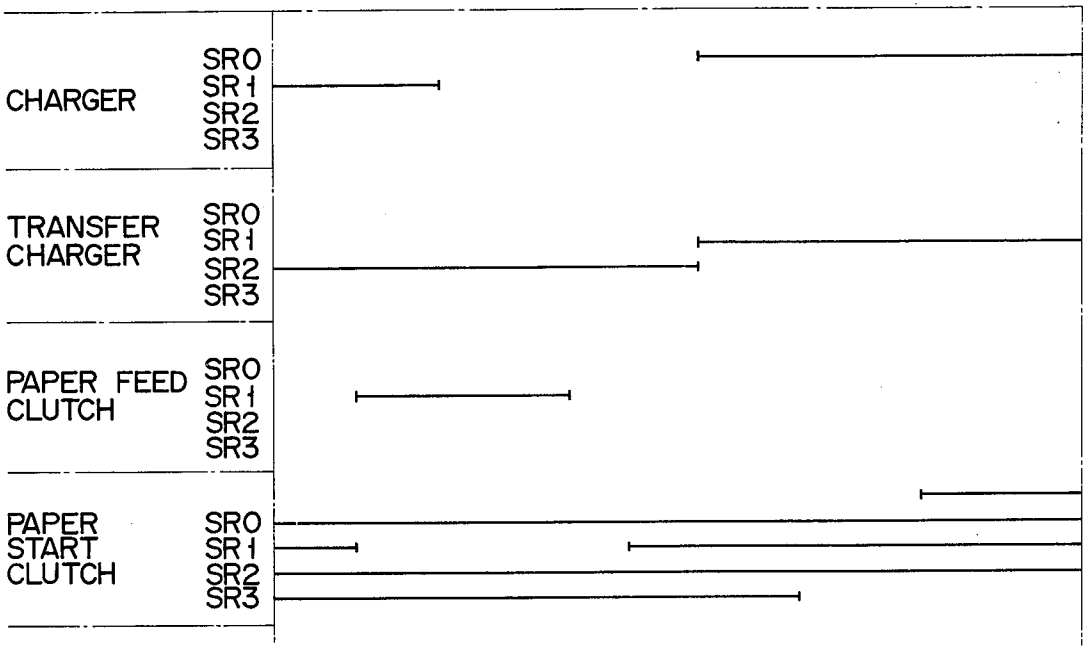

In this manner, when single copying is performed, the respective units operate in accordance with the reciprocal movement of the optical system five times (the timing disc 78 rotates two and one-half times). On the other hand, when continuous copying is performed, the same operation as in single copying is repeated to the end, delaying one cycle of the single copying. The copying operation as described above is shown with reference to the timing charts of the main units in FIG. 11.

As is apparent from the above description with reference to the flow charts, in the electronic copying machine, when the copying key 90 is depressed, the photosensitive drum 9 rotates; and the transfer charger 18, the separation charger 20, the discharger 26 and the discharge lamp 10 operate simultaneously. The leading end of the image-forming area of the photosensitive drum 9 sequentially passes the transfer charger 18, the separation charger 20, and the discharge lamp 10 from the first copying operation. The leading end of the area of the photosensitive drum 9 which was used for copying the first copying paper sheet is now located after the transfer charger 18 before the copying key 90 is depressed, that is, when the photosensitive drum 9 is not rotating. The charger 11 starts operating to initiate the copying operation so that the area of the photosensitive drum 9 which is used for the first copying operation passes the transfer charger 18, the separation charger 20, the discharger 26, and the discharge lamp 10 and then to the charger 11.

When the copying key 90 is depressed, the photosensitive drum 9 starts rotating and simultaneously the transfer charger 18, the separation charger 20, the discharger 26 and the discharge lamp 10 start operating. The predetermined area of the photosensitive drum 9 which is located after the transfer charger 18 when the photosensitive drum 9 is not rotating passes through the transfer charger 18, the separation charger 20, the discharger 26 and the discharge lamp 10 and reaches the charger 11, so that charger 11 starts operating. When the charger 11 starts operating, the exposure system, the developing unit 12, the cleaner 27 and the document table 2 start operating. As a result, the process for forming an electrostatic latent image beginning from the operation of the charger 11 is performed. When the copying operation is performed at this timing, the surface potential of the area of the photosensitive drum 9 which has passed the discharger lamp 10, that is, the surface potential of the photosensitive drum 9 when the process for forming the electrostatic latent image is performed, is maintained constant. Therefore, the concentration difference of the image on the same copying paper sheet and on the continuous copying roll of paper is prevented, thus accomplishing a good copying image.

In the electronic copying machine in which the transfer charger 18, the separation charger 20, the discharger 26, the discharge lamp 10 and the photosensitive drum 9 start operating immediately after the copying key 90 is depressed according to the above embodiment, the leading end of the area which is used for the first copying operation and which forms the electrostatic latent image thereon is located after the transfer charger 18 when the photosensitive drum 9 is not rotating. However, the present invention is not limited to the mode of operation as described above. The leading end of the image-forming area of the photosensitive drum 9 may be located so that the leading end passes at least the transfer charger 18, the separation charger 20 and the discharge lamp 10 from the first copying operation.

Figure 12:
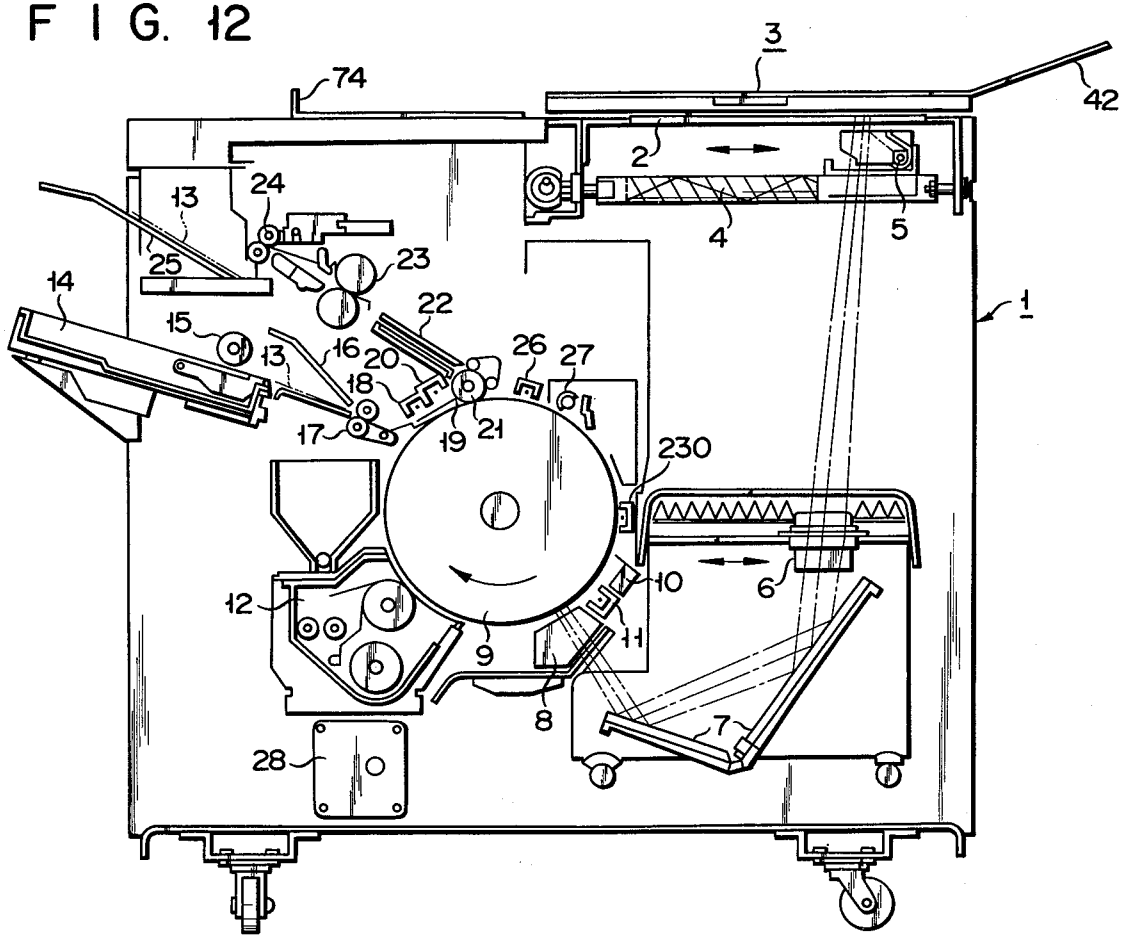
FIG. 12 is a side view showing the overall arrangement of an electronic copying machine according to another embodiment of the present invention.

An electronic copying machine according to another embodiment of the present invention will be described with reference to FIG. 12. A corona charger 230 whose charge has the same polarity as that of the charger 11, that is, opposite to the polarity of the toner image which is formed on the surface of the photosensitive drum 9, is arranged between the cleaner 27 and the discharge lamp 10. The leading end of the image-forming area of the photosensitive drum 9 may be located at a position at which the area passes the corona charger 230 and the discharge lamp 10 from the first copying operation. With this arrangement, the same effect as in the first embodiment is accomplished. Further, the area on which the toner image is formed may be as close as the charger 11 when the photosensitive drum 9 is not rotating. In other words, the area may be as close as the position from which the electrostatic latent image is formed, so that time for the first copying operation is shortened.

While the present invention has been particularly shown and described with reference to the preferred embodiments thereof, it will be understood by those skilled in the art that various changes in form and details may be made therein without departing from the spirit and scope of the present invention.

What is claimed is:

1. An electronic copying machine having:

photosensitive means for selectively retaining an electrostatic latent image;

charger means for charging the surface of said photosensitive means;

exposure means for exposing said photosensitive means with an image from a document to form said electrostatic latent image of said document on said photosensitive means;

developing emans for applying a toner to said electrostatic latent image to form a toner image;

transfer charger means for transferring said toner image to a transfer medium;

discharge lamp means for exposing said surface of said photosensitive means to render said photosensitive means conductive so that charges on said surface are neutralized; and control means for controlling a charging timing of said charger means and an exposure timing of said exposure means in such a manner that, even when making a first copy a leading end of a toner-image forming area of said photosensitive means, which corresponds to a leading end of the transfer medium, is first exposed to said transfer charger means and said discharge lamp means before being charged by said charger means in a polarity the same as said transfer charger means so that said leading end of said area can be exposed by said exposure means.

2. An elecrronic copying machine accordingtto claim 1, wherein said control means comprises a programmable microprocessor connected to at least said charger means and said exposure means and includes a central processing unit which receives a timing signal in order to control said charger means and said exposure means and a read-only memory device which stores a permanent program and a predetermined timing constant for determing a charging timing of said charger means and an exposure timing of said exposure means, said read-only memory device having the permanent program which is for said central processing unit and according to which said control means performs a predetermined function, whereby the charging time of said charger means and the exposure timing of said exposure means are controlled in such a manner that, from a first copying operation, the leading end of the toner-image forming area of said photosensitive means is charged by said charger means after being affected by said transfer charger means, and said discharge lamp means and the leading end of the toner-image forming area is exposed by said exposure means.

3. An electronic copying machine according to claim 1 or 2, wherein the charging timing of said charger means and the exposure timing of said exposure means are controlled in such a manner that the leading end of the toner-image forming area of said photosensitive means corresponds to a leading end of the transfer medium and is located immediately before said transfer charger means at rest.

4. An electronic copying machine having:

photosensitive means for selectively retaining an electrostatic latent image;

charger means for charging the surface of said photosensitive means;

exposure means for exposing said photosensitive means with an image from a document to form said electrostatic latent image of said document on said photosensitive means;

developing means for applying a toner to said electrostatic latent image to form a toner image; for transfer charger means for transferring said toner image to a transfer medium;

separating charger means for radiating an AC corona to neutralize charges produced by said transfer charger means thereby separating the transfer medium from said photosensitive means;

discharge lamp means for exposing said surface of said photosensitive means to render said photosensitive means conductive so that charges on said surface of the photosensitive means are neutralized;

corona charger means having a polarity opposite to the polarity of said toner image and being disposed between said transfer charger means and said discharge lamp means; and control means for controlling a charging timing of said charger means and an exposure timing of said exposure means in such a manner that even when making a first copy, a leading end of a toner-image forming area of said photosensitive means, which corresponds to a leading end of the transfer medium, is first exposed to said corona charger means and said discharge lamp means before being charged by said charging means and exposed by said exposure means.

5. An electronic copying machine according to claim 4, wherein said control means comprises a programmable microprocessor connected to at least said charger means and said exposure means and includes a central processing unit which receives a timing signal in order to control said charger means and said exposure means and a read-only memory device which stores a permanent program and a predetermined timing constant for determining the charging timing of said charger means and the exposure timing of said exposure means, said read-only memory device having the permanent program which is for said central processing unit and according to which said control means performs a predetermined function, whereby the charging time of said charger means and the exposure timing of said exposure means are controlled in such a manner that, from the first copying operation, the leading end of the toner-image forming area of said photosensitive mean which corresponds to the leading end of the transfer medium, is charged by said charger means after being affected by said corona charger means and said discharge lamp means, and is exposed by said exposure means.

6. An electronic copying machine according to claim 4 or 5, wherein the charging timing of said charger means and the exposure timing of said exposure means are controlled in such a manner that the leading end of the toner-image forming area of said photosensitive means corresponds to the leading end of the transfer medium and, is located immediately before said corona charger means at rest.

* * * * *